US009225086B2

(12) United States Patent
Takeuchi et al.

(10) Patent No.: US 9,225,086 B2
(45) Date of Patent: Dec. 29, 2015

(54) BOARD-TO-BOARD CONNECTOR WITH MATING INDICATING MEANS

(75) Inventors: Ryotaro Takeuchi, Kanagawa (JP); Toshihisa Hirata, Kanagawa (JP); Yoshikazu Ito, Kanagawa (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 13/805,907

(22) PCT Filed: Jun. 28, 2011

(86) PCT No.: PCT/US2011/042178

§ 371 (c)(1),
(2), (4) Date: Mar. 13, 2013

(87) PCT Pub. No.: WO2012/006086

PCT Pub. Date: Jan. 12, 2012

(65) Prior Publication Data

US 2013/0210270 A1 Aug. 15, 2013

(30) Foreign Application Priority Data

Jun. 28, 2010 (JP) ..... 2010-146047

(51) Int. Cl.
*H01R 4/26* (2006.01)
*H01R 12/71* (2011.01)

(52) U.S. Cl.
CPC ..... *H01R 12/716* (2013.01)

(58) Field of Classification Search
CPC ..... H01R 13/7036
USPC ..... 439/489, 490, 188; 200/51.09
See application file for complete search history.

(56) References Cited

U.S. PATENT DOCUMENTS

| | | | | | |
|---|---|---|---|---|---|
| 3,960,428 | A | * | 6/1976 | Naus et al. | 439/315 |
| 4,050,769 | A | * | 9/1977 | Ammon | 439/701 |
| 4,053,724 | A | * | 10/1977 | Llona | 200/51 R |
| 4,083,617 | A | * | 4/1978 | Wyatt | 439/295 |
| 4,084,875 | A | * | 4/1978 | Yamamoto | 439/274 |
| 4,379,606 | A | * | 4/1983 | Clark et al. | 439/76.1 |
| 4,891,013 | A | * | 1/1990 | Komaki | 439/66 |

(Continued)

FOREIGN PATENT DOCUMENTS

| | | | |
|---|---|---|---|
| JP | S63-199474 U | | 12/1988 |
| JP | 2001-257019 | * | 9/2001 |
| WO | WO 2011-142132 A1 | | 11/2011 |

OTHER PUBLICATIONS

International Search Report for PCT/US2011/042178.

*Primary Examiner* — Neil Abrams

(57) ABSTRACT

A board-to-board connector comprises a first connector, a second connector and a switch. The first connector includes a first terminal and a first housing. The first housing includes a recessed portion and a first reinforcing bracket. The second connector includes a second terminal and a second housing. The second housing includes a raised portion and a second reinforcing bracket. The raised portion is insertable into the recessed portion. The switch detects the fit completion of the first connector and the second connector. The switch includes a plurality of switching members, each with the ability to contact another switching member. To signal mating, in one embodiment, an arm mounted on a bracket is pressed against a pad of a circuit board. In another embodiment, a contact portion on one housing contacts two members on the other housing. In another embodiment, the switch includes a connection between terminals disposed on each connector.

7 Claims, 16 Drawing Sheets

(56) References Cited

U.S. PATENT DOCUMENTS

| | | | | | |
|---|---|---|---|---|---|
| 5,174,787 | A * | 12/1992 | Shirai et al. | 439/489 |
| 5,273,456 | A * | 12/1993 | Muzslay | 439/489 |
| 5,451,158 | A * | 9/1995 | Lin et al. | 439/79 |
| 5,470,251 | A * | 11/1995 | Sano | 439/489 |
| 5,572,395 | A * | 11/1996 | Rasums et al. | 361/58 |
| 5,641,299 | A | 6/1997 | Meguro et al. | |
| 5,651,685 | A * | 7/1997 | Brinkman et al. | 439/79 |
| 5,876,238 | A * | 3/1999 | Thomsen | 439/489 |
| 6,022,244 | A * | 2/2000 | Chiu | 439/570 |
| 6,056,590 | A * | 5/2000 | Takahashi et al. | 439/489 |
| 6,457,991 | B1 * | 10/2002 | Yu | 439/489 |
| 6,471,539 | B1 * | 10/2002 | Yu | 439/489 |
| 6,619,965 | B1 * | 9/2003 | Kihira et al. | 439/74 |
| 6,695,640 | B2 * | 2/2004 | Uchibori et al. | 439/490 |
| 6,793,506 | B1 | 9/2004 | Hirata et al. | |
| 6,817,906 | B2 * | 11/2004 | Zhou | 439/752.5 |
| 6,827,596 | B2 * | 12/2004 | Hori | 439/188 |
| 6,896,541 | B2 * | 5/2005 | Benson | 439/489 |
| 7,128,581 | B2 | 10/2006 | Igarashi et al. | |
| 7,137,839 | B2 * | 11/2006 | Dilliner et al. | 439/315 |
| 7,152,126 | B2 * | 12/2006 | Sandy et al. | 710/301 |
| 7,167,372 | B2 * | 1/2007 | Mori et al. | 361/731 |
| 7,431,605 | B2 * | 10/2008 | Dieterle et al. | 439/358 |
| 7,470,144 | B2 * | 12/2008 | Murata et al. | 439/489 |
| 7,845,958 | B2 | 12/2010 | Hoshino et al. | |
| 7,914,319 | B2 * | 3/2011 | Jones et al. | 439/489 |
| 7,931,477 | B2 | 4/2011 | Hirata et al. | |
| 8,075,324 | B2 * | 12/2011 | Yamaji et al. | 439/188 |
| 8,465,298 | B2 | 6/2013 | Takeuchi et al. | |
| 2013/0210270 | A1 * | 8/2013 | Takeuchi et al. | 439/488 |
| 2013/0330970 | A1 * | 12/2013 | Hirata | 439/620.01 |

* cited by examiner

FIG.9
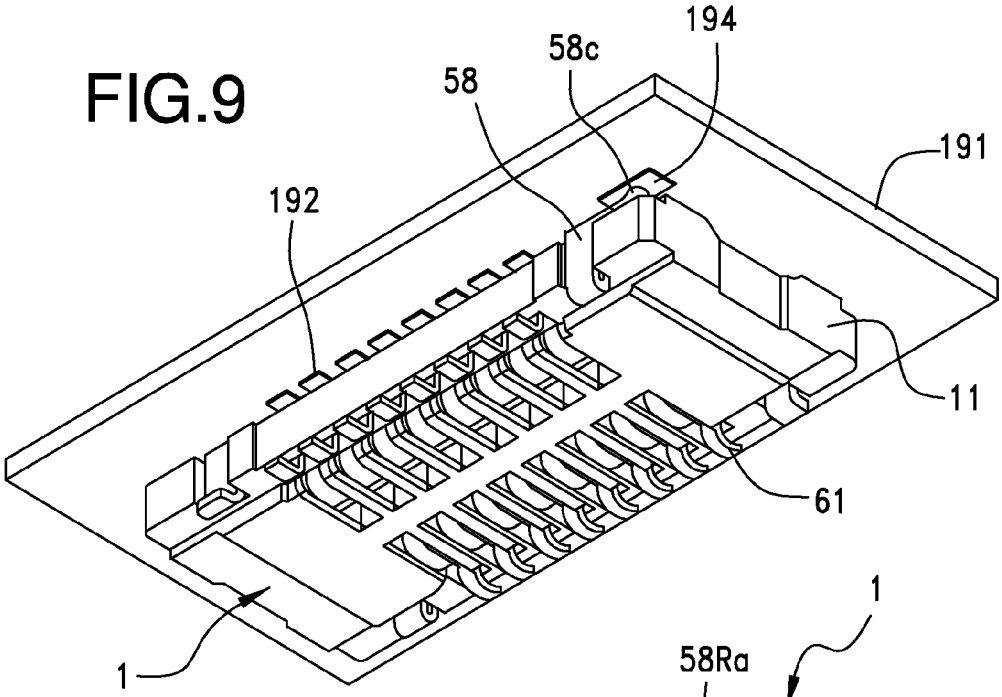
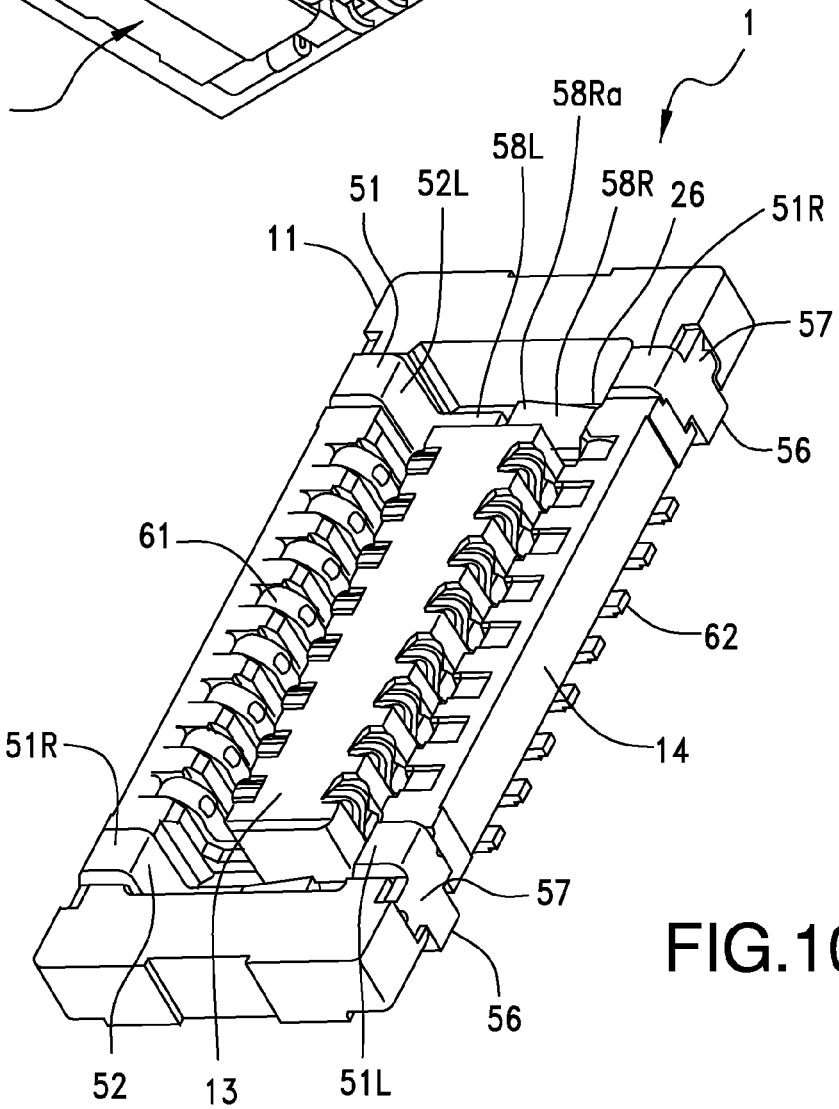
FIG.10

BOARD-TO-BOARD CONNECTOR WITH MATING INDICATING MEANS

REFERENCE TO RELATED APPLICATIONS

The Present Disclosure claims priority to prior-filed Japanese Patent Application No. 2010-146047, entitled "Board-To-Board Connector," filed 28 Jun. 2010 with the Japanese Patent Office. The content of the aforementioned patent application is fully incorporated in its entirety herein.

BACKGROUND OF THE PRESENT DISCLOSURE

The Present Disclosure relates, generally, to a board-to-board connector. More particularly, the Present Disclosure relates to a board-to-board connector having a switch that electrically detects the fit completion of a first connector and a second connector.

Board-to-board connectors have been used conventionally to electrically connect a mutual pair of parallel circuit boards. Such board-to-board connectors are configured for conductivity by mutually fitting a pair of circuit boards by each attaching mutually facing surfaces. Further, technology has been proposed that holds the fitted state with the other connector with a reinforcing bracket attached to both end parts functioning as a locking member. An example is disclosed in Japanese Patent Application No. 2004-55306.

FIG. 21 is a perspective view illustrating the pre-fit state of a conventional board-to-board connector. Reference 801 in the drawing is the first connector which is one side of a pair of board-to-board connectors, and is mounted on the surface of the first board 891. Further, reference 901 in the drawing is the second connector which is the other side of a pair of board-to-board connectors, and is mounted on the surface of the second board 991. The first connector 801 includes a first housing 811, and a plurality of first terminals 861 mounted on the first housing 811, and the second connector 901 includes a second housing 911 and a plurality of second terminals 961 mounted on the second housing 911. In addition, when the first connector 801 and the second connector 901 are fit together, the first board 891 and the second board 991 are electrically connected by the mutual contact between the corresponding first terminals 861 with the second terminals 961.

A recessed part 812 is formed on the first housing 811 to receive the second housing 911 while an engaging raised part 813 is formed within the recessed part 812. Meanwhile, an engaging recessed part 913 is formed on the second housing 911 to receive the engaging raised part 813.

In addition, a first metal fitting 851 is attached to both ends in the long side direction of the first housing 811. The first metal fitting 851 is provided with a first tail part 852 that is soldered to the surface of the first board 891, and is also provided with a first locking projection 853 that protrudes. Additionally, a second metal fitting 951 is attached to both ends in the long side direction of the second housing 911. The second metal fitting 951 is provided with a second tail part 952 that is soldered to the surface of the second board 991, and is also provided with a second locking projection 953 that protrudes.

Further, when the first connector 801 and the second connector 901 are fit together, the engaging raised part 813 and the engaging recessed part 913 are mutually engaged while the first locking projection 853 of the first metal fitting 851 and the second locking projection 953 of the second metal fitting 951 are mutually engaged. By so doing the first connector 801 and the second connector 901 are locked together and are held by a fitted state.

Moreover, at the time of fitting, either one of the first connector 801 or the second connector 901 is vertically inverted from the disposition illustrated in the drawing so as to fit with the other connector.

SUMMARY OF THE PRESENT DISCLOSURE

However, with the conventional board-to-board connector, it is difficult to confirm whether the first connector 801 and the second connector 901 are completely fit. That is to say that because either one of the first connector 801 or the second connector 901 is vertically inversed at the time of fitting and the second housing 911 is received into the recessed part 812 of the first housing 811, visual confirmation from the outside cannot be made to confirm whether the first locking projection 853 of the first metal fitting 851 positioned on the inner side of the recessed part 812 is engaged with the second locking projection 953 of the second metal fitting 951 that is attached to the second housing 911.

Reasonably, if there is a large degree of projection by the second housing 911 from the top end of the first housing 811, a determination can be made visually whether the fit of the first connector 801 and the second connector 901 is incomplete. However, because the first board 891 and the second board 991 which have significantly larger surface areas than the bottom surfaces of the first housing 811 and the second housing 911, are attached to the bottom surface of the first housing 811 and the second housing 911, visual confirmation of the degree of projection by the second housing 911 from the top end of the first housing 811 is difficult.

Particularly, due to advancements in smaller and low height board-to-board connectors in recent years, making an accurate visual confirmation of the degree of projection by the second housing 911 from the top end of the first housing 811, and making an accurate determination whether the first connector 801 and the second connector 901 are completely fixed has become extremely difficult.

An object of the Present Disclosure, in solving the problem of the conventional board-to-board connector, is to provide a board-to-board connector that can accurately confirm fit completion with high reliability for the first connector and the second connector even in a fitting process of a small size and low height board-to-board connector by electrically detecting the fit completion of the first connector and second connector, and can securely prevent the occurrence of incomplete fitting in a fitting process.

Therefore, the board-to-board connector of the Present Disclosure includes a first connector having a first terminal and a first housing provided with a recessed part, a second connector having a second terminal that contacts the first terminal and a second housing provided with a raised part that inserts into the recessed part, wherein a switch is provided that electrically detects the fit completion of the first connector and the second connector.

With another board-to-board connector of the Present Disclosure, further, the first connector has a first reinforcing bracket equipped on the first housing, the second connector has a second reinforcing bracket equipped on the second housing, and the switch includes a plurality of switching members with the ability to mutually contact and at least one of the switching members is the first reinforcing bracket or the second reinforcing bracket.

With another board-to-board connector of the Present Disclosure, further, at least one of the switching members can flexibly displace in the fit direction of the first connector and the second connector.

With still another board-to-board connector of the Present Disclosure, further, at least one of the switching members functions as a stop to prevent more than necessary relative displacement in the fit direction of the first connector and the second connector.

With still another board-to-board connector of the Present Disclosure, further, one of either the first terminal or second terminal is provided with a contacting recessed part and the other is provided with a contacting raised part, and when the contacting recessed part and the contacting raised part engage, the switch detects the fit completion of the first connector and the second connector.

According to the Present Disclosure, the board-to-board connector electrically detects the fit completion of the first connector and the second connector. By so doing, fit completion of the first connector and the second connector can be accurately confirmed even in a fitting process of a small size and low height board-to-board connector, and the occurrence of incomplete fitting can be securely prevented in the fitting process thereby increasing reliability.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 9 is a perspective view illustrating the completion of the fitting process, seen from the fitting surface side of the first connector of FIG. 1;

FIG. 10 is a perspective view, seen from the fitting surface side of a first connector according to the second embodiment of the Present Disclosure;

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
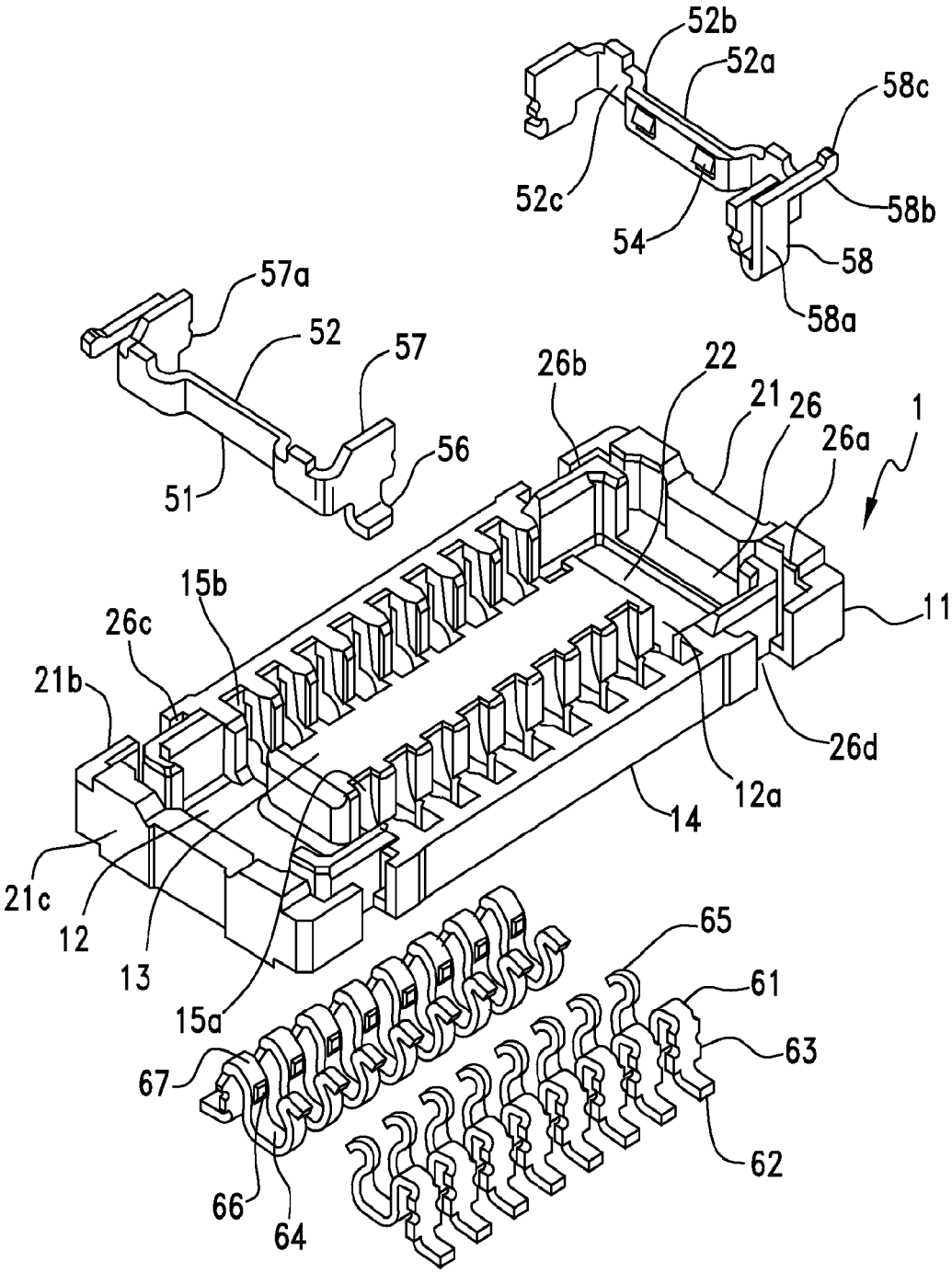
FIG. 1 is an exploded view, seen from the fitting surface side, of a first connector according to the first embodiment of the Present Disclosure.
Figure 2:
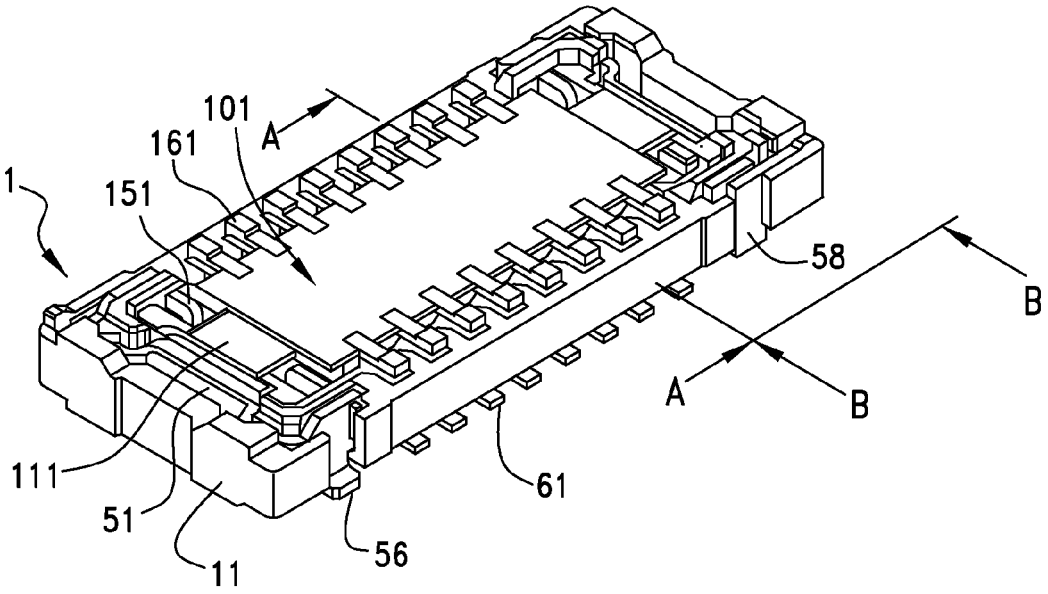
FIG. 2 is a perspective view, illustrating the fitting of the first connector and a second connector, as seen from the view of FIG. 1.

Referring to the Figures generally, and in particular FIGS. 1-2, 1 is the first connector as one side of a pair of board-to-board connectors according to the present embodiment, and is a surface mount type connector mounted on the surface of the first board not illustrated. Furthermore, 101 is the second connector as the other side of a pair of board-to-board connectors according to the present embodiment, and is a surface mount type connector mounted on the surface of the second board 191 to be described hereinafter. The board-to-board connector according to the present embodiment includes the first connector 1 and a second connector 101, and electrically connects the first board and the second board 191. Moreover, the first board and the second board 191 can be any type of board including, for example, a printed circuit board used in electronic devices or the like, such as, a flexible flat cable (FFC), a flexible printed circuit (FPC), or the like.

Further, the first connector 1 includes a first housing 11 as a connector main body that is integrally formed by an insulating material such as a synthetic resin or the like. The first housing 11, as illustrated in the drawing, is provided with an essentially rectangular thick board shape that is essentially a rectangular solid, and a recessed part 12 having an essentially rectangular shape is formed around the periphery on the side where the second connector 101 engages, in other words, on the fitting surface side (top side in the drawing). The connector 1 is provided with dimensions such as approximately 10.0 mm long, approximately 2.5 mm wide, and approximately 1.0 mm thick, and these dimensions can be suitably changed. Further, a first ridged part 13 is integrally formed with the first housing 11 as an island part within the recessed part 12, and a side wall part 14 is integrally formed with the first housing 11 to extend in parallel with the first ridged part 13 on both sides of the first ridged part 13. In this case, the first ridged part 13 and the side wall part 14 protrude upward from the bottom surface of the recessed part 12 and extend in the long side direction of the first housing 11. By so doing, a recessed groove part 12*a*, that is a long and narrow recessed part, is formed between the first ridged part 13 and the side wall part 14 so as to extend in the long side direction of the first housing 11 as a part of the recessed part 12 on both sides of the first ridged part 13. Moreover, in the example illustrated in the drawings, there is only one first ridged part 13, but there may also be a plurality thereof, and there may be any number of these. In addition, the first ridged part 13 is provided with a dimension of, for example, 0.6 mm in width, and this dimension can be suitably changed.

Here, a first terminal receptacle inner side cavity 15*a* is formed in a recessed groove shape to the side surface of both sides of the first ridged part 13. Further, a first terminal receptacle outer side cavity 15*b* is formed in a recessed groove shape to the side surface of the inner side of the side wall part 14. Additionally, because the first terminal receptacle inner side cavity 15*a* and the first terminal receptacle outer side cavity 15*b* are mutually integrated and joined at the bottom part of the recessed groove part 12*a*, when describing the first terminal receptacle inner side cavity 15*a* and the first terminal receptacle outer side cavity 15*b*, it will be referred to integrally as the first terminal receptacle cavity 15.

The first terminal receptacle cavity 15 is formed in, for example, eight pieces each at a pitch of approximately 0.4 mm to both sides of the first ridged part 13. Further, the first terminal 61 received into each of the first terminal receptacle cavities 15 is also arranged in, for example, eight pieces each at a pitch of approximately 0.4 mm to both sides of the first ridged part 13. Note, the pitch and number of first terminal receptacle cavities 15 can be suitably changed.

The first terminal 61 is a member integrally formed by a working process such as stamping or bending a conductive metal plate, and is provided with a retention receiving part 63, a tail part 62 that is connected to the lower end of the retention receiving part 63, an upper side connecting part 67 that is connected to the upper end of the retention receiving part 63, a second contacting part 66 as a second contacting raised part that is formed in the vicinity of the inner end of the upper side connecting part 67, a lower side connecting part 64 that is connected to the second contacting part 66, and a first contacting part 65 as a first contacting raised part that is formed in the vicinity of the free end of the lower side connecting part 64.

Further, the retention receiving part 63 extends in a vertical direction, that is to say the thickness direction, of the first housing 11 and is a part that is engaged and held with the first terminal receptacle outer side cavity 15*b*. In addition, the tail part 62 is connected by bending in relation to the retention receiving part 63, and extends outward in the lateral direction, that is to say the width direction, of the first housing 11, and is connected by soldering or the like to a terminal connection pad that is linked to a conductive trace on the first board. Furthermore, the upper side connecting part 67 is connected by bending in relation to the retention receiving part 63 and extends inward in the width direction of the first housing 11.

The curved second contacting part 66 is bent facing downward to the inner direction of the upper side connecting part 67 and is formed to protrude inward in the width direction of the first housing 11. Further, the lower side connecting part 64 is a part provided with a U shaped side surface shape that is connected to the lower end of the second contacting part 66. The curved first contacting part 65 is bent in a U shape in the vicinity of the free end, that is to say, the upper end of the inner side, of the lower side connecting part 64 and is formed to protrude outward in the width direction of the first housing 11.

The first terminal 61 is inserted into the first terminal receptacle cavity 15 from the mounting surface side (lower side in the drawing), and is anchored to the first housing 11 by being held from both sides by the side walls of the first terminal receptacle outer side cavities 15*b* where the retention receiving part 63 is formed to the side surface of the inner side of the side wall part 14. In this state, in other words the state in which the first terminal 61 is loaded on the first housing 11, the first contacting part 65 and the second contacting part 66 are positioned on both the left and right sides of the recessed groove part 12*a* so as to face each other.

Moreover, the first terminal 61 is a member that is integrally formed by a working process of a metal plate and therefore has a certain amount of flexibility. As is evident from its shape, there is the possibility of flexible deformation in the gap between the mutually facing first contacting part 65 and the second contacting part 66. In other words, when the second terminal 161 of the second connector 101 is inserted between the first contacting part 65 and a second contacting part 66, by so doing, the gap between the first contacting part 65 and the second contacting part 66 flexibly elongates.

In addition, first overhanging end parts 21 are each arranged as first engaging guide parts to both ends in the long side direction of the first housing 11. Each first overhanging end part 21 has an overhanging end recessed part 22 formed as a part of the recessed part 12. The overhanging end recessed part 12 is a nearly rectangular shaped recessed part that is connected to both ends in the long side direction of each recessed groove part 12*a*. Further, the overhanging end part 22 functions as an inserting recessed part when the second overhanging end part 122, to be described hereinafter provided by the second connector 101, is inserted and when the first connector 1 and the second connector 101 are in a fitted state.

In addition, the first overhanging end part 21 is provided with a side wall extending part 21*b* that extends in the long side direction of the first housing 11 from both sides in the long side direction of the side wall part 14, and an end wall part 21*c* that extends in the short side direction of the first housing 11 and is connected to the side wall extending part 21*b* on both ends. With every first overhanging end, the end wall part 21*c* and the side wall extending part 21*b* connected to both ends thereof, form a side wall in the form of a continuous C shape and mark three directions of the nearly rectangular shaped overhanging end recessed part 22.

Furthermore, a first reinforcing bracket 51 is attached as a reinforcing metal fitting to the first overhanging end part 21. The first reinforcing bracket 51 is arranged to the outer side in the long side direction of the first housing 11 for the overhanging end recessed part 22 and is received and held within the first metal fitting retention recessed part 26 formed on the first overhanging end part 21.

The first reinforcing bracket 51 in the present embodiment is a member that is integrally formed by a working process such as punching or bending a conductive metal plate and is provided with a first main body part 52 in the shape of a long and narrow band that extends in the width direction of the first housing 11 as a complete body, a first arm part 57 that is connected by bending to both the left and right ends of the first main body part 52 and extends in the long side direction of the first housing 11 and is held to the first housing 11, a first board connecting part 56 that is connected to the bottom end of the first arm part 57 of one end, a fit completion detecting part 58 connected to the bottom end of the first arm part 57 of the other end, and a first locking part 54 that is formed on the first main body part 52.

Further, the first main body part 52 is provided with a center part 52*a* that extends linearly in the width direction of the first housing 11 as viewed from the insert and release direction, that is to say the vertical direction, of the first connector 1 and the second connector 101, a bending part 52*b* that bends so as to form a crank shape as viewed from the vertical direction and is attached to both ends of the center part 52, and an outer side end part 52*c* that extends linearly in the width direction of the first housing 11 as viewed from the vertical direction and extends out in the width direction of the first housing 11 from the bending part 52*b*.

In addition, the first arm part 57 extends toward the center in the long side direction of the first housing 11 from the outer side end of the outer side end part 52*c*, and is provided with a first lock latching part 57*a* in a raised and recessed shape at the free ends thereof.

Further, the first board connecting part 56 is connected to the lower end of one side of the first armed part 57 and is connected by bending so that the free ends thereof face the outer side in the width direction of the first housing 11. The first board connecting part 56 functions as a soldering tail part for the first reinforcing bracket 51, and the bottom surface thereof is formed so as to be nearly parallel with the mounting surface not illustrated of the first housing 11 and is anchored by soldering or the like to an anchoring pad on the first board.

Further, a main body part 58*a* of the fit completion detecting part 58 is connected to the lower end of the other end of the first arm part 57 by bending so as to extend upward. A base end of the long and narrow lever shaped arm part 58*b* that extends in the long side direction of the first housing 11 is connected to the upper end of the main body part 58*a*. The arm part 58*b* functions as a spring member and the tip end thereof, in other words the free end, can be flexibly displaced in the vertical direction. Further, a connecting raised part 58*c* that protrudes upward is formed on the free end of the arm part 58*b*. The upper end of the connecting raised part 58*c* is a part positioned at the upward-most side on the fitting surface side of the first connector 1 when the first reinforcing bracket 51 is attached to the first housing 11. In addition, the detection circuit that detects the fit completion between the first connector 1 and the second connector 101 closes by conductivity when contacting the detection pad 194 to be described hereinafter formed on the surface of the second board 191.

The first metal fitting retention recessed part 26 is provided with an outer side end part receptor 26*a* in a groove shape that extends in the width direction and the thickness direction of the first housing 11, a first arm part receptor 26*b* in a groove shape that extends in the long side direction and in the thickness direction of the first housing 11 and is formed on the side wall extending part 21*b* so as to link with the outer side end part receptor 26*a*, a first lock receiving latch part 26*c* arranged on the end part approaching the center in the long side direction of the first housing 11 in the first arm part receptor 26*b* with the first lock latching part 57*a* latches, and the connecting part receptor opening 26*d* that links with the first arm part receptor 26*b* opens to the outer surface of the side wall extending part 21*b* so that the first board in connecting part 56 or the fit completion detecting part 58 can be viewed from the outside.

Figure 3:
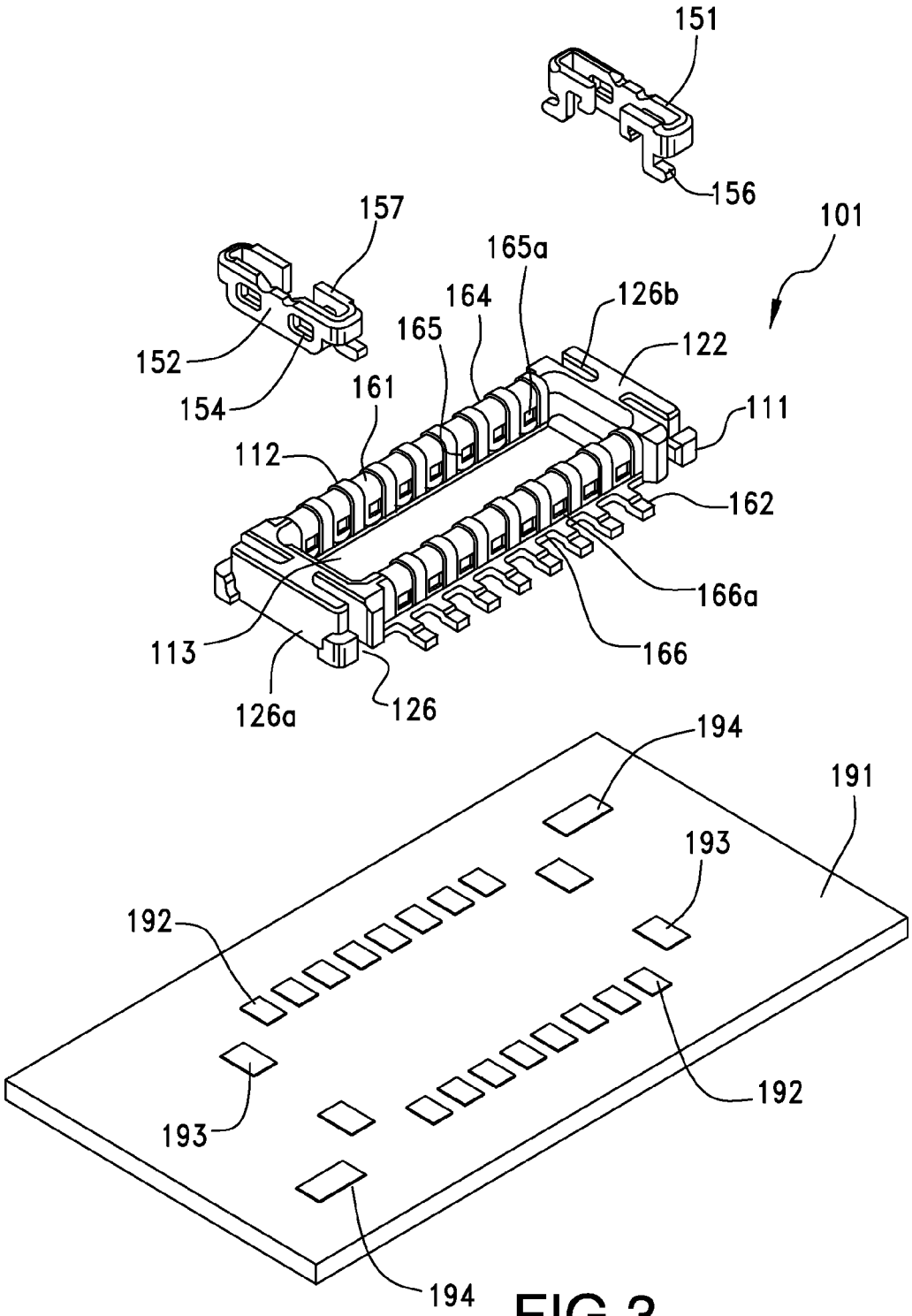
FIG. 3 is an exploded view, seen from the fitting surface side, of the second connector and second board according to the first embodiment of the Present Disclosure.
Figure 4:
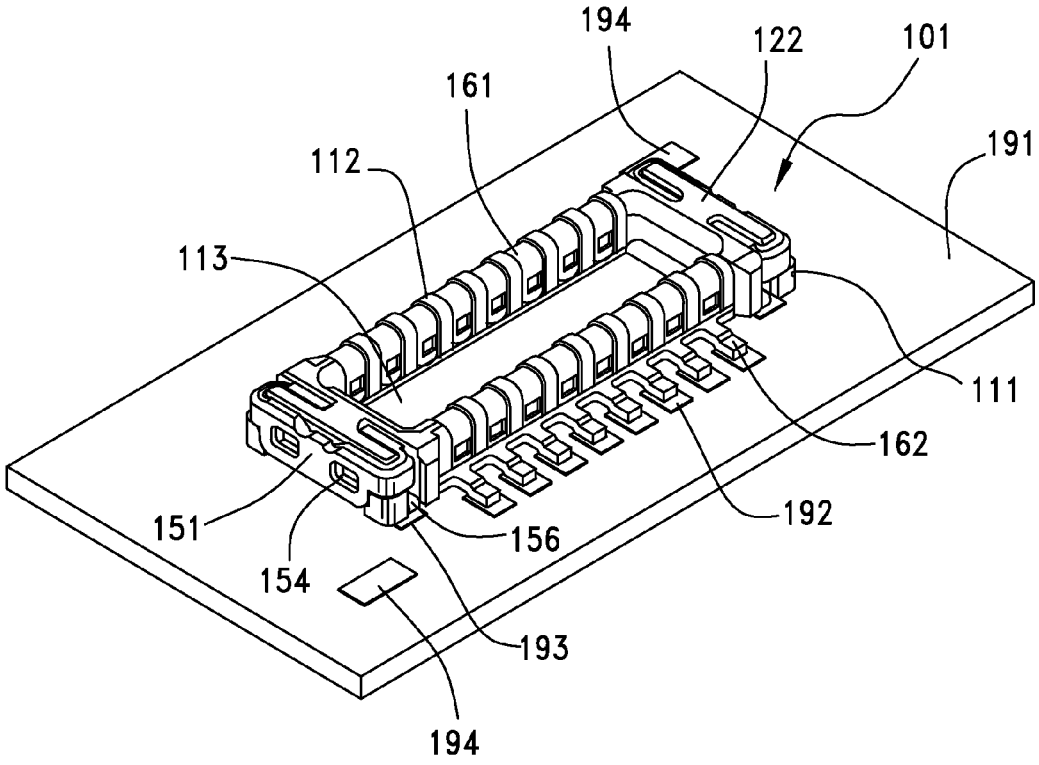
FIG. 4 is a perspective view, seen from the fitting surface side of the second connector mounted on the surface, of the second board of FIG. 3.

Referring in more detail to FIGS. 3-4, the second connector 101 includes a second housing 111 as a connector main body that is integrally formed by an insulating material such as a synthetic resin or the like. The second housing 111, as illustrated in the drawing, is essentially a rectangular thick board shape that is essentially a rectangular solid, and is provided with dimensions such as approximately 8.0 mm long, approximately 1.5 mm wide, and approximately 0.8 mm thick, and these dimensions can be suitably changed. Further, a long and narrow recessed groove part 113 that extends in the long side direction of the second housing 111 and a long and narrow raised part second ridged part 112 that extends in the long side direction of the second housing 111 are integrally formed on the side in which the first connector 1 of the second housing 111 is inserted, in other words, the fitting surface side (upper side in the drawing) while marking the outside of the recessed groove part 113. The second ridged part 112 is formed along both sides of the second housing 111 and along both sides of the recessed groove part 113. In addition, each of the second ridged parts 112 have a second terminal 161 arranged as terminals.

As illustrated in the drawing, the recessed groove part 113 is stopped by the bottom part on the side where it is mounted on the second board 191. Moreover, although there are two second ridged parts 112 in the example illustrated in the drawing, it can also be singular and there can be any number thereof. In addition, the recessed groove part 113 is provided with a dimension of, for example, 0.7 mm in width, and this dimension can be suitably changed.

The second terminal 161 is a member integrally formed by a working process such as stamping or bending a conductive metal plate, and is provided with a main body part not illustrated in the drawing, a tail part 162 that is connected to the bottom end of the main body part, a first contacting part 165 that is connected to the top end of the main body part, a connecting part 164 that is connected to the top end of the first contacting part 165, and a second contacting part 166 that is connected to the outer end of the connecting part 164. Further, a first contacting recessed part 165*a* that engages with the first contacting part 65 of the first terminal 61 is formed on the surface of the first contacting part 165, and a second contacting recessed part 166*a* that engages with the second contacting part 66 of the first terminal 61 is respectively formed on the surface of the second contacting part 166.

Further, the main body part is a part that is held by surrounding the periphery of the second housing 111, and is a part not illustrated in FIG. 3 and FIG. 4. Additionally, the tail part 162 is connected to the bottom end that extends in the lateral direction of the main body part, that is to say the width direction of the second housing 111, and extents outward of the second housing 111, and is connected by soldering or the like to a terminal connection pad 192 that is linked to a conductive trace on the second board 191.

Further, in addition to the terminal connection pad 192, an anchoring pad 193 and a detection pad 194 are formed on the surface of the second board 191. Each of the terminal connection pads 192 are linked to a conductive trace not illustrated that correspond to each of the second terminals 161. In addition, each of the detection pads 194 are linked to a conductive trace of a detection circuit not illustrated to detect the fit completion between the first connector 1 and the second connector 101. In addition, the anchoring pad 193 is not necessarily linked to a conductive trace but is linked to a conductive trace that functions as, for example, a ground line when using the second reinforcing bracket 151 to function as a ground terminal or the like.

Further, the first contacting part 165 is connected to the main body part and is a part in a flat plate shape that extends in the vertical direction, that is to say the thickness direction, of the second housing 111. Furthermore, the connecting part 164 is connected by bending in relation to the first contacting part 165 and extends outward in the width direction of the second housing 111. In addition, the second contacting part 166 is connected by bending downward to the outer end of the connecting part 164 and is a part that extends downward.

The second terminals 161 are integrated with the second housing 111 by over molding. In other words, the second housing 111 is formed by filling resin in the cavity of a mold in which the second terminals 161 are prepared inside in advance. By so doing, the second terminals 161 can be integrally attached to the second housing 111 in a state in which the main body part is embedded within the second housing 111 and the surfaces of the first contacting part 165, the connecting part 164, and the second contacting part 166 are exposed to each side surface of the second ridged part 112 as well as to the fitting surface. In this case, the second terminals 161 are arranged, for example, in 16 pieces each at a pitch of approximately 0.4 mm. Moreover, the pitch and number of second terminals 161 can be suitably changed.

In addition, second overhanging end parts 122 are each arranged as second engaging guide parts to both ends in the long side direction of the second housing 111. The second overhanging end part 122 is a thick member that extends in the width direction of the second housing 111 where both ends are connected to both ends in the long side direction of each second ridged part 112, and the upper surface thereof provides an essentially rectangular shape. Further, the second overhanging end part 122 functions as an inserting ridged part when the first overhanging end part 21 provided by the first connector 1 is inserted and when the first connector 1 and the second connector 101 are in a fitted state.

Furthermore, a second reinforcing bracket 151 is attached as a reinforcing metal fitting to the second overhanging end part 122. The second reinforcing bracket 151 is arranged along the outer side end in the long side direction of the second housing 111 for the second overhanging end part 122 and is received and held within the second metal fitting retention recessed part 126 formed on the second overhanging end part 122.

The second reinforcing bracket 151 in the present embodiment is a member that is integrally formed by a working process such as punching or bending a conductive metal plate and is provided with a second main body part 152 in the shape of a long and narrow band that extends in the width direction of the second housing 111 as a complete body, a second arm part 157 that is connected by bending to both the left and right ends of the second main body part 152 and extends in the with direction of the second housing 111 and is held to the second housing 111, a second board connecting part 156 that is connected to the bottom end of the second arm part 157, and a second locking part 154 that is formed on the second main body part 152. The second board connecting part 156 functions as a soldering tail part for the second reinforcing bracket 151, and the bottom surface thereof is formed so as to be nearly parallel with the mounting surface not illustrated of the second housing 111 and is anchored by soldering or the like to an anchoring pad 193 on the second board 191.

In addition, the second metal fitting detention recessed part 126 is provided with a second main body part receptor 126*a* that is an outer side surface in the long side direction of the second housing 111 in the second overhanging end part 122, and a second arm part receptor 126*b* that is groove shaped and extends in the width direction and the thickness direction of the second housing 111 and is formed so so as to release to the side surface of the second overhanging end part 122.

Moreover, the second reinforcing bracket 151 received in its near entirety within the second metal fitting retention recessed part 126 when attached to the second overhanging end part 122, and the outer side surface in the long side direction of the second housing 111 in the second main body part 152 is exposed to the outer side surface in the long side direction of the second housing 111 in the second overhanging end part 122, and the lower surface of the second board connecting part 156 is exposed to the mounting surface of the second housing 111. Further, the second locking part 154 engages with the first locking part 54 of the first reinforcing bracket 51 provided by the first connector 1 when the first connector 1 and the second connector 101 are in a fitted state.

Referring to FIGS. 5-9, the first connector 1 is surface mounted on the first board with the tail part 62 of the first terminals 61 being connected by soldering or the like to the terminal connection pad that is linked to a conductive trace on the first board not illustrated in the drawing while the first board connecting part 56 of the first reinforcing bracket 51 is connected by soldering or the like to the anchoring pad on the first board, and the lower end surface of the main body part 58*a* in the fit completion detecting part 58 of the first reinforcing bracket 51 is connected by soldering or the like to the detection pad. Moreover, the first board is omitted from the drawing for convenience in the explanation.

Further, the second connector 101 is surface mounted on the second board 191 with the tail part 162 of the second terminals 161 being connected by soldering or the like to the terminal connection pad 192 that is linked to a conductive trace on the second board 191, and the second board connecting part 156 of the second reinforcing bracket 151 is connected by soldering or the like to the anchoring pad 193 of the second board 191.

Figure 5:
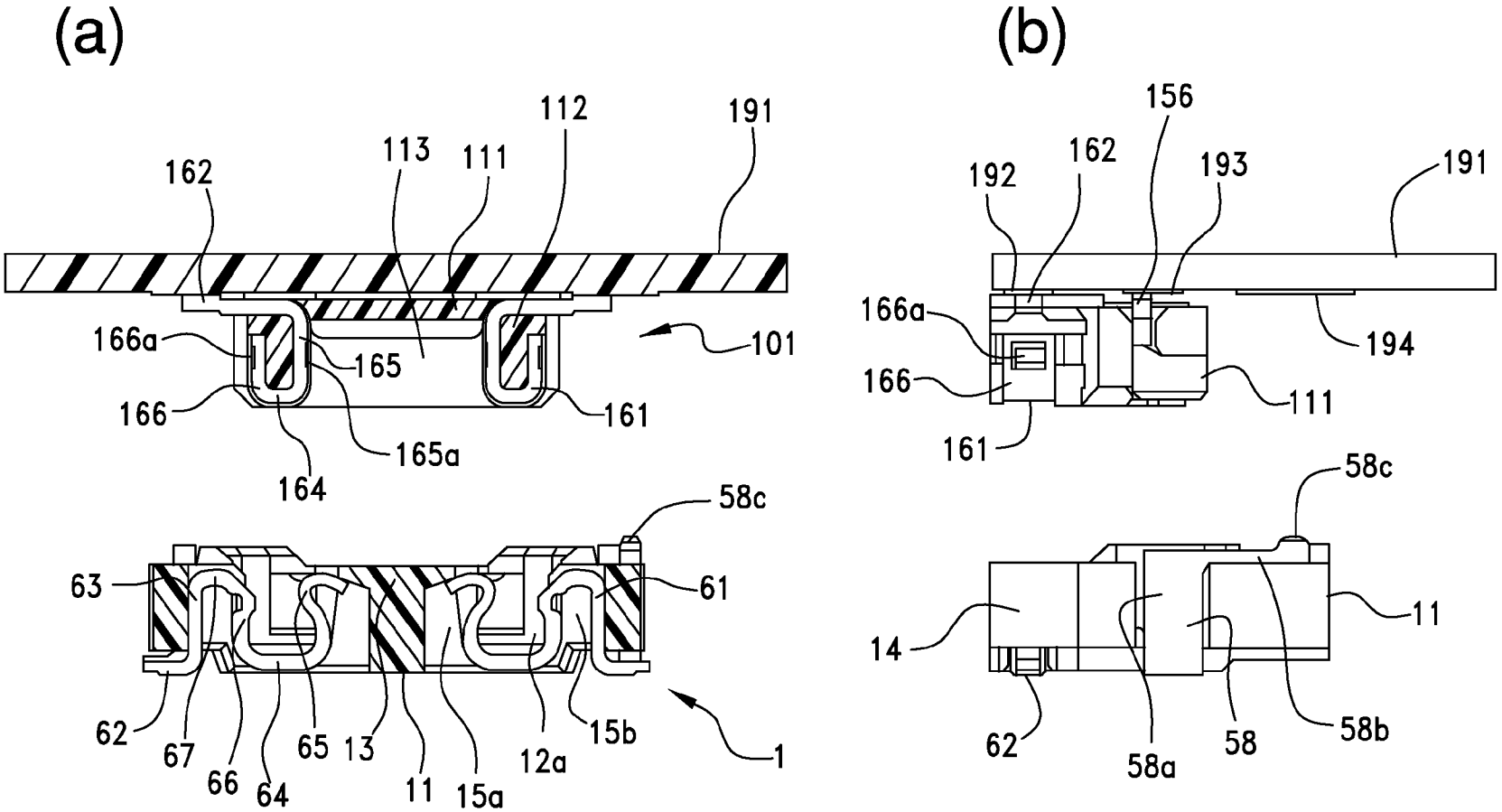
FIG. 5 illustrates the first step of the fitting process of the board-to-board connector according to the first embodiment of the Present Disclosure, where FIG. 5(*a*) is a cross-sectional view corresponding to the visual portion of Arrows A-A in FIG. 2 and FIG. 5(*b*) is a side plane view corresponding to the visual portion of Arrows B-B in FIG. 2.

First, the operator, as illustrated in FIG. 5, puts the fitting surface of the first connector 1 and the fitting surface of the second connector 101 into opposing dispositions, and when the position of the left and right second ridged parts 112 of the second connector 101 matches the positions of the left and right recessed groove parts 12*a* of the first connector 1, the position matching is complete between the first connector 1 and the second connector 101.

Figure 6:
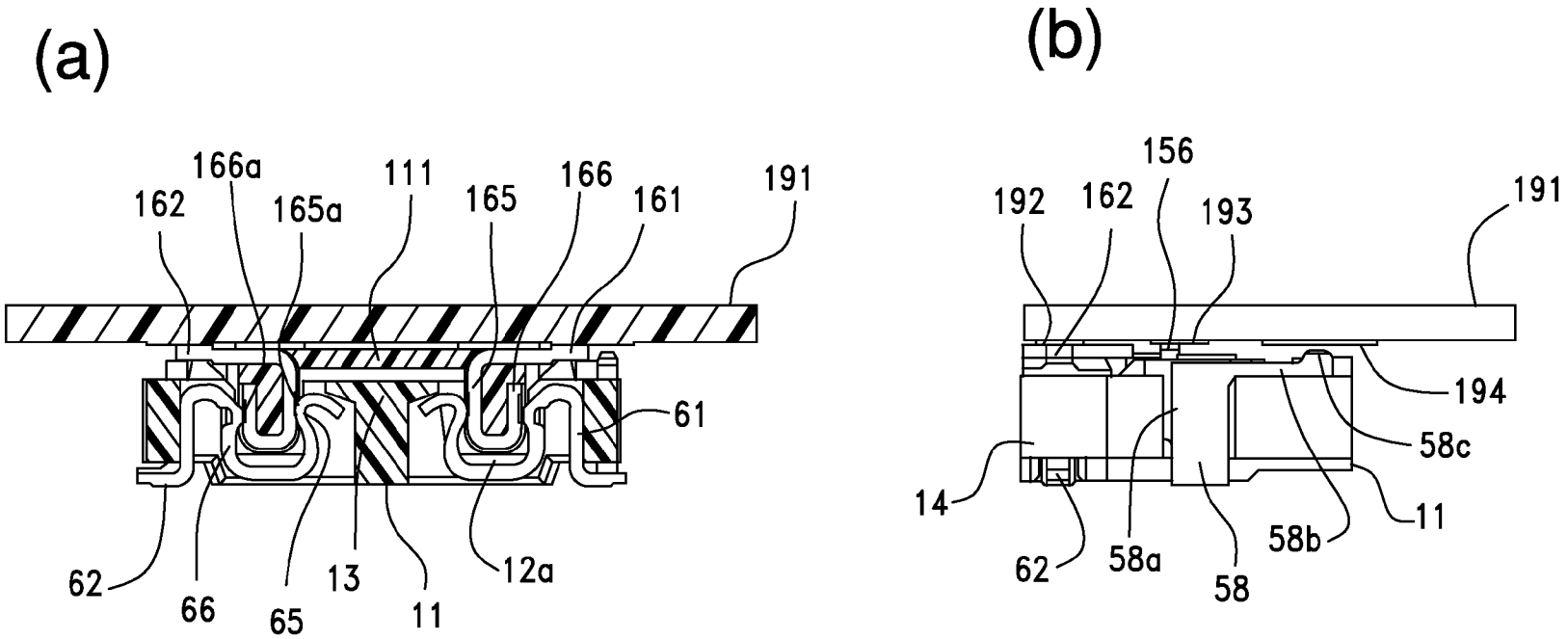
FIG. 6 illustrates the second step of the fitting process, where FIG. 6(*a*) is a cross-sectional view corresponding to the visual portion of Arrows A-A in FIG. 2 and FIG. 6(*b*) is a side plane view corresponding to the visual portion of Arrows B-B in FIG. 2.

In this state, when moving the first connector 1 and/or the second connector 101 in the direction that approaches the other, and other words in a fitting direction, as illustrated in FIG. 6, the left and right second ridged parts 112 of the second connector 101 are inserted into the left and right recessed groove parts 12*a* of the first connector 1. Further, the second terminals 161 of the second connector of 101 are inserted between the first contacting parts 65 and the second contacting parts 66 of each of the first terminals 61, and the first contacting parts 65 of the first terminals 61 contact with the first contacting parts 165 of the second terminals 161 and the second contacting parts 66 of the first terminals 61 contact with the second contacting parts 166 of the second terminals 161.

In the state illustrated in FIG. 6, the first contacting part 65 of the first terminals 61 contact the surface of the first contacting part 165 of the second terminals 161, and the second contacting part 66 of the first terminals 61 contact the surface of the second contacting part 166 of the second terminals 167. By so doing, the gap between the first contacting part 65 and the second contacting part 66 in the first terminals 61 is widened by the second terminals 161 to flexibly elongate. Moreover, with the second terminals 161, the gap between the first contacting part 165 and the second contact in part 166 undergoes virtually no deformation. Further, the connecting raised part 58*c* of the fit completion detecting part 58 does not contact the detection pad 194 of the second board 191.

Figure 7:
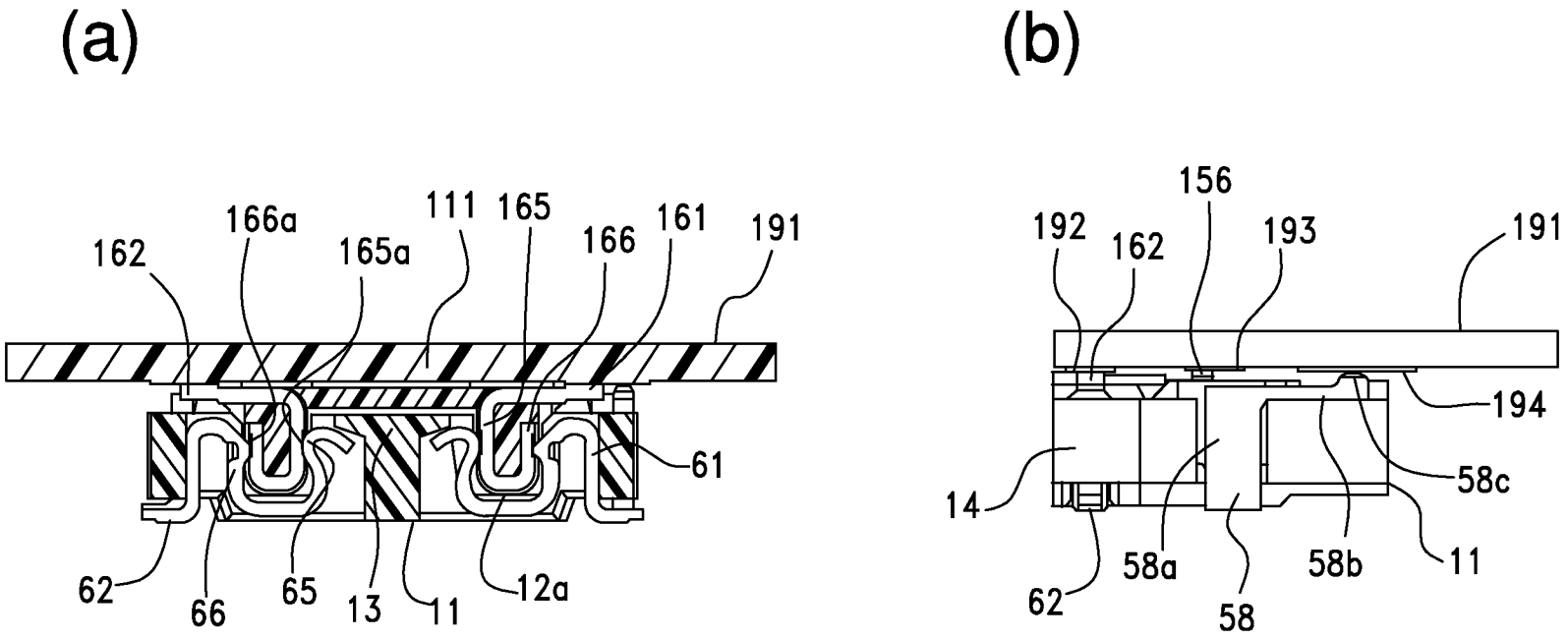
FIG. 7 illustrates the third step of the fitting process, where FIG. 7(*a*) is a cross-sectional view corresponding to the visual portion of Arrows A-A in FIG. 2 and FIG. 7(*b*) is a side plane view corresponding to the visual portion of Arrows B-B in FIG. 2.

Next, when the operator further moves the second connector 101 relatively in the fitting direction in relation to the first connector 1, the fit between the first connector 1 and the second connector 101 is complete, and as illustrated in FIG. 7, the first contacting part 65 of the first terminals 61 engage with the first contacting recessed part 165*a* of the second terminals 161, and the second contacting part 66 of the first terminals 61 is in an engaged state with the second contacting recessed part 166*a* of the second terminals 161.

As a result, there is conductivity with the conductive trace connected to the terminal connection pad on the first board where the tail part 62 of the first terminal 61 is connected, and with the conductive trace connected to the terminal connection pad 192 on the second board 191 where the tail part 162 of the second terminal 161 is connected.

Further, a locked state occurs in which the first reinforcing bracket 51 provided by the first connector 1 and the second reinforcing bracket 151 provided by the second connector 101 mutually engage. As a result, the first connector 1 and the second connector 101 are locked.

In addition, the connecting raised part 58*c* of the fit completion detecting part, as illustrated in FIGS. 7 and 9, has conductivity by the upper end thereof contacting the detection pad 194 of the second board 191. As a result, the detection circuit for detecting the fit completion between the first connector 1 and the second connector 101 closes, and the fit completion between the first connector 1 and the second connector 101 is electrically detected. In other words, the fit completion detecting part 58 and the detection pads 194 function as a switching member for a fit completion detection switch.

Further, the timing for conductivity for when the connecting raised part 58*c* of the fit completion detecting part 58 contacts the detection pads 194 of the second board 191 is after the first contacting part 65 of the first terminals 61 complete engagement with the first contacting recessed part 165*a* of the second terminals 161 and after the second contacting part 66 of the first terminals 61 complete engagement with the second contacting recessed part 166*a* of the second terminals 161. In other words, the configuration is such that while the first contacting part 65 of the first terminals 61 contact the surface of the first contacting part 165 of the second terminals 161 but has still not yet entered into the first contacting recessed part 165*a*, or while the second contacting part 66 of the first terminals 61 contacts the surface of the second contacting part 166 of the second terminals 161 but has still not yet entered into the second contacting recessed part 166*a*, the connecting raised part 58*c* of the fit completion detecting part 58 does not contact the detection pad 194 of the second board 191 and fit completion between the first connector 1 and the second connector 101 is not detected.

The detection circuit is configured so that, for example, a conductive trace formed on the surface of the second board 191 and linked to the detection pads 194, and a conductive trace formed on the surface of the first board not illustrated and linked to the anchoring pads anchored by the first reinforcing bracket 51 connected to both terminals of a testing device similar to a tester for testing the conductivity state of electric circuits. By so doing, when when there is conductivity by the connecting raised part 58*c* of the fit completion detecting part 58 contacting the detection pad 194 of the second board 191, that is to say the switch for fit completion detection is switched on, the detection circuit closes and the state of conductivity is detected by the testing device.

Furthermore, when bowing or warpage occurs in the first board not illustrated or the second board 191, as illustrated in FIG. 7, even though the first contacting part 65 of the first terminals 61 engages with the first contacting recessed part 165*a* of the second terminals 161, and the second contacting part 66 of the first terminals 61 is in an engaged state with the second contacting recessed part 166*a* of the second terminals 161, the connecting raised part 58*c* of the fit completion detecting part 58 does not contact the detection pad 194 of the second board 191 so there are times in which the fit completion between the first connector 1 and a the second connector 101 cannot be electrically detected.

Figure 8:
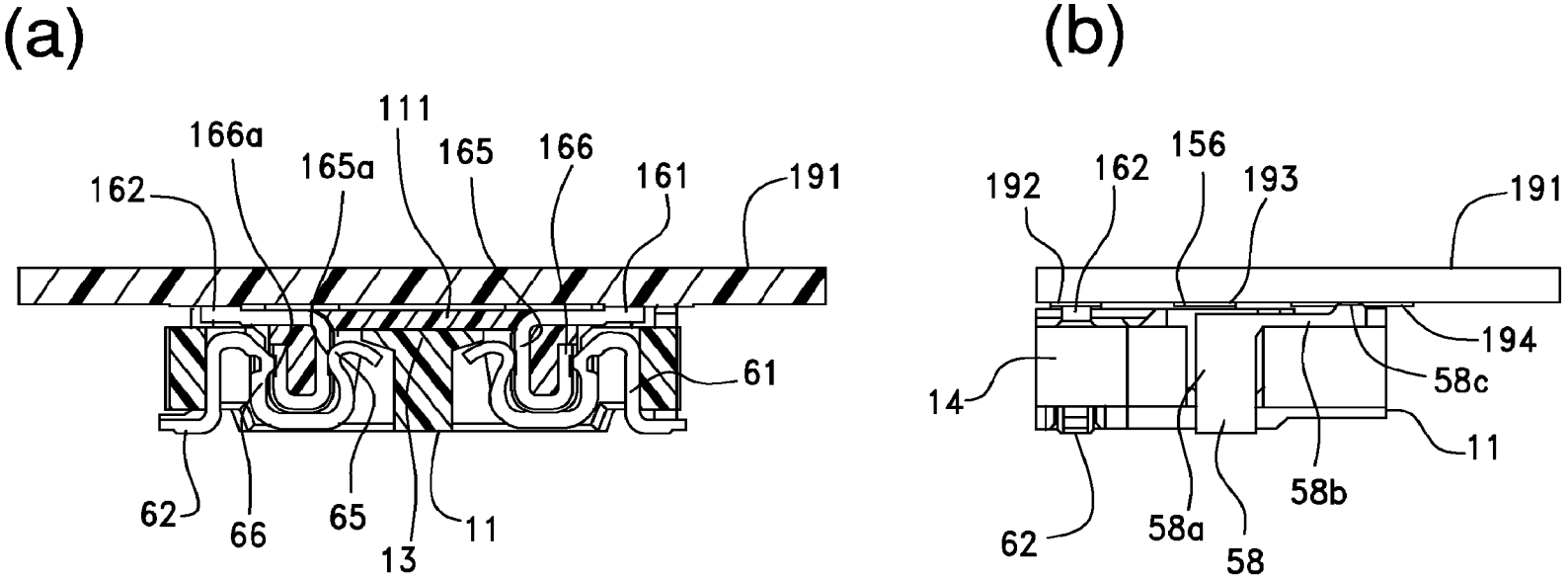
FIG. 8 illustrates the fourth step of the fitting process, where FIG. 8(*a*) is a cross-sectional view corresponding to the visual portion of Arrows A-A in FIG. 2 and FIG. 8(*b*) is a side plane view corresponding to the visual portion of Arrows B-B in FIG. 2.

At such a time, the operator further moves the second connector 101 relatively in the fitting direction in relation to the first connector 1 from the state illustrated in FIG. 7, and the connecting raised part 58*c* of the fit completion detecting part 58 contacts the detection pad 194 of the second board 191 to make conductivity by establishing the state illustrated in FIG. 8, and the fit completion between the first connector 1 and the second connector 101 is electrically detected.

When establishing the state illustrated in FIG. 8, because the upper surface of the first ridged part 13 of the first housing 11 contacts the bottom surface of the recessed groove part 113 of the second housing 111, further movement by the second connector 101 in the fitting direction in relation to the first connector 1 is prevented. In other words, the first ridged part 13 of the first housing 11 and the recessed groove part 113 of the second housing 111 functions as a stopper to prevent more than necessary relative movement in the fitting direction of the second connector 101 in relation to the first connector 1. By so doing, because the second connector 101 is not pushed in more than is necessary, in other words more than the state illustrated in FIG. 8, in relation to the first connector 1, members such as the first terminal 61, the second terminal 161, and so forth are prevented from receiving damage.

In addition, because the connecting ridged part 58*c* of the fit completion detecting part 58 can flexibly displace in a vertical direction due to the arm part 58*b* functioning as a spring member, even if the second connector 101 moves further in the relative fitting direction in relation to the first connector 1 from the state illustrated in FIG. 7, the conductive state with the detection pad 194 of the second board 191 can be maintained. In addition, the detection pad 194 and the connecting ridged part 58*c* do not receive any damage.

Thereby, when the fit between the first connector 1 and the second connector 101 is complete, the first terminal 61 and the second terminal 161 are in a state of conductivity. More specifically, the first contacting part 65 of the first terminal 61 engages with the first contacting recessed part 165*a* of the second terminal 161 to create an engaged state between the second contacting part 66 of the first terminal 61 and the second contacting recessed part 166*a* of the second terminal 161. As a result, there is conductivity with the conductive trace connected to the terminal connection pad on the first board where the tail part 62 of the first terminals 61 are connected, and with the conductive trace connected to the terminal connection pad 192 on the second board 191 where the tail part 162 of the second terminals 161 are connected. In this case, because the first terminals 61 and the second terminals 161 are contacting at multiple points, the state of conductivity can be security maintained.

Further, a locked state occurs in which the first reinforcing bracket 51 provided by the first connector 1 and the second reinforcing bracket 151 provided by the second connector 101 mutually engage. In this case, the first locking part 54 of the first reinforcing bracket 51 which is a ridged part enters into the second locking part 154 of the second reinforcing bracket 151 which is an open part so that the first locking part 54 and the second locking part 154 mutually engage thereby locking the first connector 1 and the second connector 101.

In addition, the description given in the present embodiment included the fit completion detecting part 58 of the first reinforcing bracket 51 and the detection pad 194 of the second board 191 functioning as switching members of a switch for fit completion detection, but a configuration is also possible in which a detection pad similar to the detection pad 194 can be formed on the first board and a portion of the first reinforcing bracket 51 can be made to contact such detection pad thereby enabling a switch for fit completion detection. In other words, as long as at least one from among a plurality of switching members capable of mutual contact included with the switch is the first reinforcing bracket 51 or the second reinforcing bracket 151, it is acceptable.

In addition, a description was provided only for the case in which the detection pad 194 did not displace with the connecting ridged part 58*c* of the fit completion detecting part 58 having the ability to flexibly displace in the fitting direction, but it may also be a portion of the detection pad 194 (for example the surface) that has the ability for flexible displacement in the fitting direction. In other words, as long as at least one from among a plurality of switching members capable of mutual contact included with the switch has the ability for flexible displacement in the fitting direction, it is acceptable.

In this manner, because in the present embodiment the first connector 1 and the second connector 101 are configured so as to electrically detect the fit completion, the fit completion between the first connector 1 and the second connector 101 can be accurately confirmed without the operator seeing, feeling with his hand, hearing a click sound, or the like, or in other words relying on the five senses of the operator. Accordingly, a board-to-board connector with high reliability can be provided that can securely prevent the occurrence of incomplete fitting in a fitting process even when fit completion is difficult to confirm by an operator seeing, feeling with his hand, hearing a click sound, or the like, when the first connector 1 and the second connector 101 have a small size and low height.

Furthermore, the first reinforcing bracket 51 in the present embodiment, in addition to improving the original mounting strength of the first connector 1 on the first board, also provides the locking function with the second connector 101 and is used as a part of the detection circuit for detecting the fit completion. Therefore, because it is not necessary to attach a member for detecting the fit completion to the first connector 1 and the second connector 101, increasing the size and the number of components in the first connector 1 or the second connector 101 can be prevented. In addition, because the first terminals 61 or the second terminals 161 are not used in the detection circuit, the number of terminals or the number of poles are essentially not reduced.

In addition, in the present embodiment, a pair of fit completion detecting parts 58 are placed on a diagonal line of the first connector 1 as viewed from the fitting surface side, and a pair of detection pads 194 are placed on a diagonal line of the second connector 101 making it difficult to be affected by bowing or warpage in the first board or the second board 191, and therefore the fit completion between the first connector 1 and the second connector 101 can be securely detected. Further, even if bowing or warpage occurs in the first board or the second board 191, the fit completion can be detected by further moving the first connector 1 or the second connector 101 relatively in the fitting direction as described above.

Figure 11:
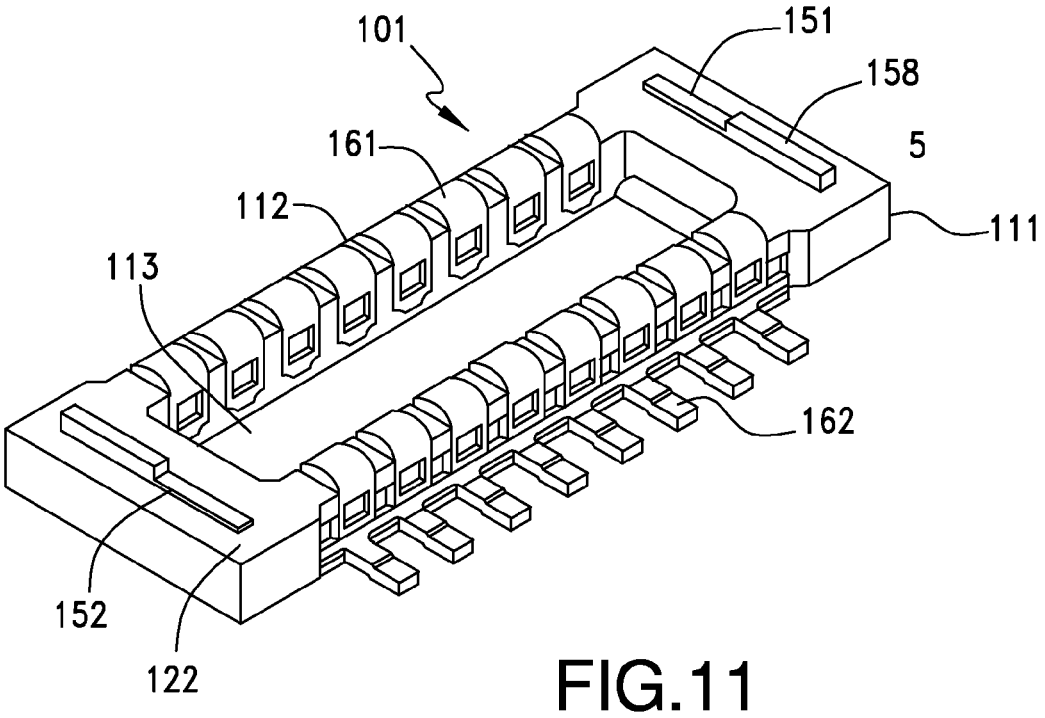
FIG. 11 is a perspective view, seen from the fitting surface side of a second connector according to the second embodiment of the Present Disclosure.
Figure 12:
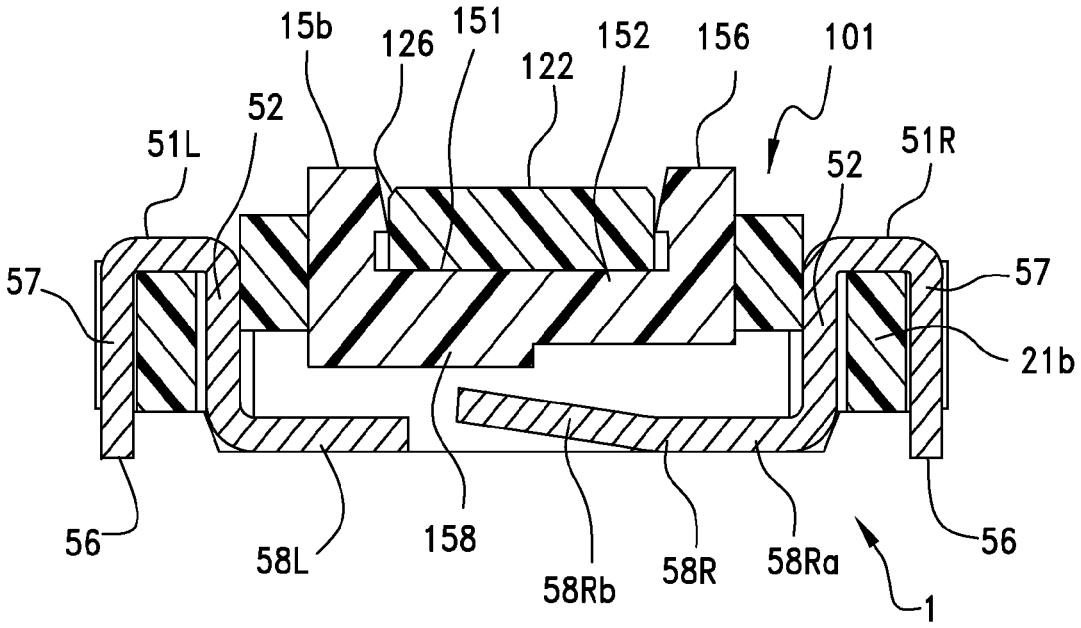
FIG. 12, which illustrates a mid-way step in the fitting process of the board-to-board connector, is a cross-sectional view illustrating the relationship of a first reinforcing bracket and a second reinforcing bracket according to the second embodiment of the Present Disclosure.
Figure 14:
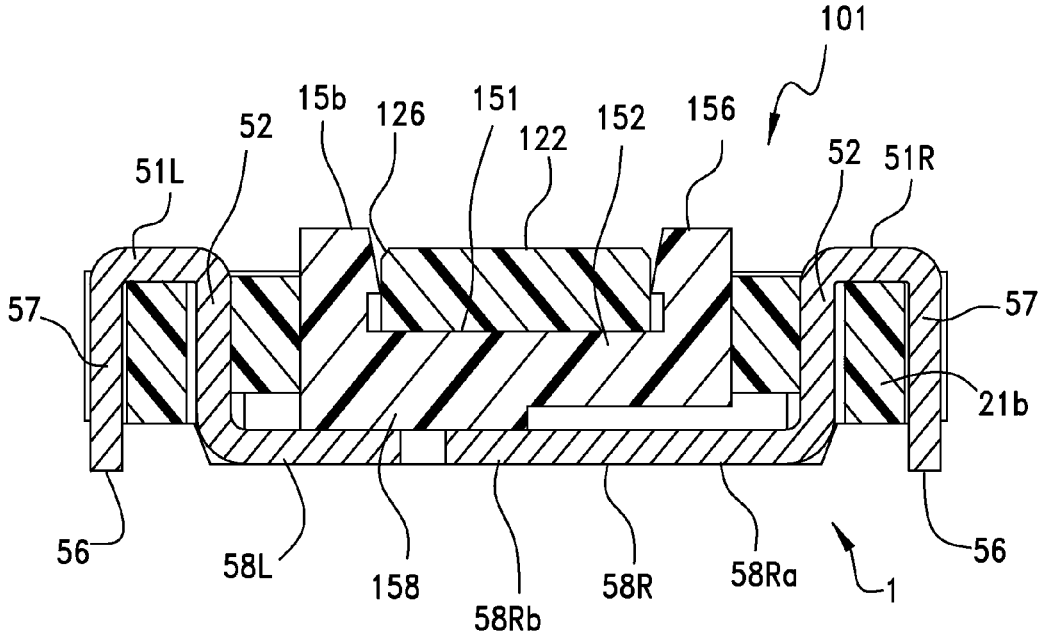
FIG. 14 is a cross-sectional view illustrating the relationship of the first reinforcing bracket and the second reinforcing bracket of FIG. 12, in the completion stage of FIG. 13.

Referring to FIGS. 10-11, the first reinforcing bracket 51 of the first connector 1 in the present embodiment separates the flexible part 51R positioned to the right side from the rigid part 51L positioned to the left side as illustrated in FIG. 12 and FIG. 14 to be described below. Further, the flexible part 51R and the rigid part 51L, respectively, are members integrally formed by a working process such as punching or bending a conductive metal plate, and are provided with a first main body part 52, a first arm part 57 connected to the first main body part 52 and held to the first housing 11, and a first board connecting part 56 connected to the lower end of the first on part 57. Note, neither the flexible part 51R nor the rigid part 51L are provided with a first locking part 54.

Further, the first board connecting part 56 functions as a soldering tail part for the flexible part 51R and the rigid part 51L, and the bottom surface thereof is formed so as to be nearly parallel with the mounting surface of the first housing 11 and is anchored by soldering or the like to an anchoring pad on the first board not illustrated.

Additionally, the flexible part 51R is connected to the lower end of the first main body part 52 and is provided with a flexible fit completion detecting part 58R that extends in the direction of the rigid part 51L; and the rigid part 51L is connected to the lower end of the first main body part 52 and is provided with a rigid fit completion detecting part 58L that extends in the direction of the flexible part 51R. The rigid fit completion detecting part 58L and the flexible fit completion detecting part 58R extend along the bottom surface of the first metal fitting retention recessed part 26 of the first housing 11.

The rigid fit completion detected part 58L is a long and narrow flat plate shaped member that extends directly along the bottom surface of the first metal fitting retention recessed part 26 or the mounting surface of the first housing 11 to be described hereinafter as illustrated in FIG. 12. In contrast to this, the flexible fit to completion detecting part 58R is provided with a main body part 58Ra that is a long and narrow flat plate shaped part that extends directly along the bottom plane of the first metal fitting retention recessed part 26 or the mounting service of the first housing 11, and an arm part 58Rb with a long and narrow cantilever shape that extends upward at a slant toward the fitting surface of the first housing 11 from the tip end of the main body part 58Ra. The arm part 58Rb functions as a spring member and the tip end thereof, in other words the free end, can be flexibly displaced in the vertical direction. As illustrated in FIG. 10, when in a state in which the second connector 101 is not engaged with the first connector 1, the free end of the arm part 58Rb is positioned further to the fitting surface side then the upper surface of the rigid fit completion detecting part 58L. In other words, it is positioned further above than the upper surface of the rigid fit completion detecting part 58L.

Further, with the example illustrated in the drawings, the flexible fit completion detecting part 58R is formed to be longer than the rigid fit completion detecting part 58L, and either the tip end of the flexible fit completion detecting part 58R or the tip end of the rigid fit completion detecting part 58L resides within the range from the end of the rigid part 51L in the width direction of the first housing 11 until the center part.

Furthermore, the second reinforcing bracket 151 of the second connector 101 in the present embodiment is a member that is integrally formed by a working process such as punching or bending a conductive metal plate and is provided with, as illustrated in FIG. 12 to be described hereinafter, a second main body part 152 in the shape of a long and narrow band that extends in the width direction of the second housing 111 as a complete body, and a second board connecting part 156 that is connected to both the left and right ends of the second main body part 152 and that extends toward the mounting surface. Note, in the present embodiment, the second reinforcing bracket 151 is not provided with a second locking part 154.

The second reinforcing bracket 151 is integrated with the second housing 111 by over molding. In other words, the second housing 111 is formed by filling resin in the cavity of a mold in which the second reinforcing bracket 151 is prepared inside in advance. By so doing, the second reinforcing bracket 151 can be integrally attached to the second housing 111 in a state in which the majority of the second main body part 152 is embedded within the second housing 111 and the upper end part of the second main body part 152 is exposed to the fitting surface, and the lower end part of the second board connecting part 156 is exposed to the mounting surface.

Further, the second board connecting part 156 functions as a soldering tail part for the second reinforcing bracket 151, and the bottom surface thereof is formed so as to be nearly parallel with the mounting surface of the second housing 111 and is anchored by soldering or the like to an anchoring pad 193 on the second board 191.

Further, the second fit completion detecting part 158 is integrally formed on the upper end part of the second main body part 152 so as to further protrude from the upper end surface thereof. The second fit completion detecting part 158, in the example illustrated in the drawing, is formed on the upper side surface of the second main body part 152 within the range from one end of the width direction of the second housing 111 until the center part, which more specifically is a range that is approximately either the right half or the left half of the upper end surface of the second main body part 152.

In the state in which the first connector 1 has completed engagement with the second connector 101, the upper end surface of the second fit completion detecting part 158 is the portion that has conductivity by contacting with the upper surface of the rigid fit completion detecting part 58L and the flexible fit completion detecting part 58R. Accordingly, the second fit completion detecting part 158 is formed within a range that is approximately half of the side that corresponds to the range in which the tip end of the rigid fit completion detecting part 58L and the flexible fit the completion detecting part 58R are positioned in the first connector 1 has the other connector. Moreover, the dimensions in regards to the width direction of the second housing 111 of the second fit completion detecting part 158 are not required to always be approximately half of the upper end surface of the second main body part 152 as in the example illustrated in the drawing, but may be shorter or may be longer than that.

In the present embodiment, the detection circuit is configured so that a conductive trace is formed on the surface of the first board not illustrated where the first board connecting part 56 of the flexible part 51R is linked to a fixed anchoring pad, and a conductive trace where the first board connecting part 56 of the rigid part 51L is linked to a fixed anchoring pad, by connecting to both terminals of a testing device similar to a tester for testing the conductivity state of the electric circuits. By so doing, when conductivity occurs by the upper surface of the rigid fit completion detecting part 58L and the flexible fit completion detecting part 58R of the first connector 1 contacting the upper end surface of the second fit completion detecting part 158 of the second connector 101, the detection circuit closes and the conductivity state is detected by the testing device and thus the fit completion between the first connector 1 and the second connector 101 is electrically detected. In other words, in the present embodiment, the second fit completion detecting part 158 together with the rigid fit completion detecting part 58L and the flexible fit completion detecting part 58R function as a switching member for a fit completion detection switch.

Note, the present embodiment does not require that the detection pad 194 be formed on the second board 191. Further, in the present embodiment, other points of configuration are the same as the first embodiment, and therefore descriptions thereof are omitted.

Referring to FIGS. 12-4, the first connector 1 is surface mounted on the first board with the tail part 62 of the first terminals 61 being connected by soldering or the like to the terminal connection pad 192 that is linked to a conductive trace on the first board not illustrated, and the first board connecting part 56 of the rigid part 51L and the flexible part 51R is connected by soldering or the like to the anchoring pad of the first board. Moreover, the first board is omitted from the drawing.

Further, the second connector 101 is surface mounted on the second board 191 with the tail part 162 of the second terminals 161 being connected by soldering or the like to the terminal connection pad 192 that is linked to a conductive trace on the second board 191, and the second board connecting part 156 of the second reinforcing bracket 151 is connected by soldering or the like to the anchoring pad 193 of the second board 191. Note, the present embodiment omits the second board 191 from the drawing.

First, the operator, in a similar manner to the first embodiment, positions the first connector 1 and the second connector 101 to make a state in which the fitting surface of the first connector 1 faces the fitting surface of the second connector 101 then moves the first connector 1 and/or a second connector 101 in a direction to approach the side of the other, that is to say the fitting direction.

By so doing, the left and right second ridged parts 112 of the second connector 101 are inserted into the left and right recessed groove parts 12*a* of the first connector 1. Further, the second terminals 161 of the second connector of 101 are inserted between the first contacting parts 65 and the second contacting parts 66 of each of the first terminals 61, and the first contacting parts 65 of the first terminals 61 contact with the surfaces of the first contacting parts 165 of the second terminals 161 and the second contacting parts 66 of the first terminals 61 contact with the surfaces of the second contacting parts 166 of the second terminals 161. By so doing, the gap between the first contacting part 65 and the second contacting part 66 in the first terminals 61 is widened by the second terminals 161 to flexibly elongate. Further, as illustrated in FIG. 12, the upper surface of the rigid fit completion detecting part 58L and the upper surface of the flexible fit completion detecting part 58R of the first connector 1 does not contact the upper end surface (the lower end surface in FIG. 12) of the second fit completion detecting part 158 of the second connector 101.

Figure 13:
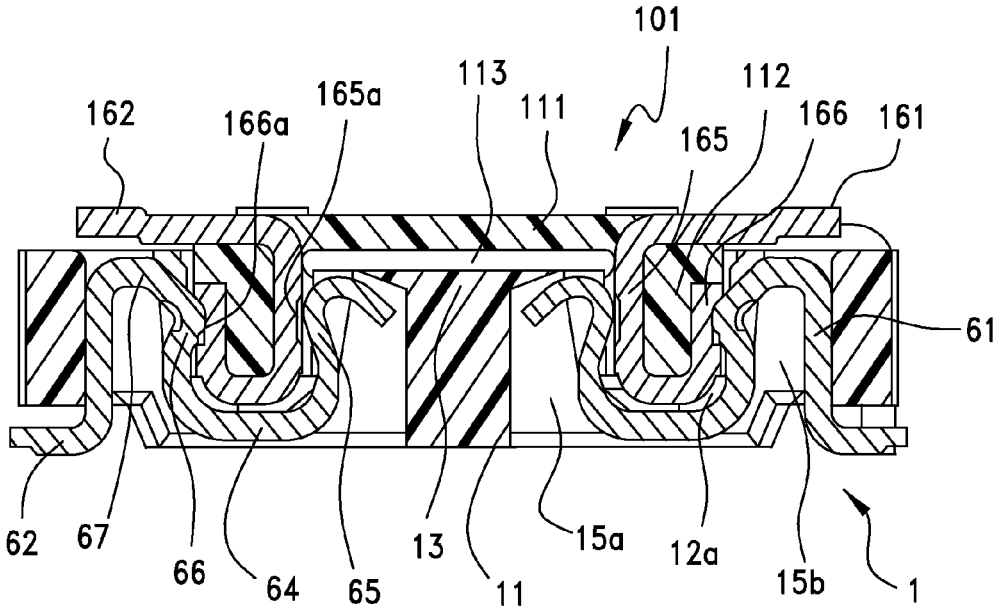
FIG. 13, which illustrates the completion of the fitting process, is a cross-sectional view illustrating the relationship of first terminals and second terminals according to the second embodiment of the Present Disclosure.

Next, when the operator further moves the second connector 101 relatively in the fitting direction in relation to the first connector 1, the fit between the first connector 1 and the second connector 101 is complete, and as illustrated in FIG. 13, the first contacting part 65 of the first terminals 61 engage with the first contacting recessed part 165*a* of the second terminals 161, and the second contacting part 66 of the first terminals 61 is in an engaged state with the second contacting recessed part 166*a* of the second terminals 161.

As a result, there is conductivity with the conductive trace connected to the terminal connection pad on the first board where the tail part 62 of the first terminal 61 is connected, and with the conductive trace connected to the terminal connection pad 192 on the second board 191 where the tail part 162 of the second terminal 161 is connected.

In addition, as illustrated in FIG. 14, the upper surface of the rigid fit completion detecting part 58L and the upper surface of the flexible fit completion detecting part 58R of the first connector 1 contacts with the upper end surface of the second fit completion detecting part 158 of the second connector 101 to create conductivity. In other words, the switch for fit completion detection is turned on. Furthermore, the detection circuit for detecting the fit completion between the first connector 1 and the second connector 101 closes, and the fit completion between the first connector 1 and the second connector 101 is electrically detected.

When establishing the state illustrated in FIG. 14, because the upper end surface of the second fit completion detecting part 158 contacts the upper surface of the rigid fit completion detecting part 58L, further movement by the second connector 101 in the fitting direction in relation to the first connector 1 is prevented. In other words, the rigid fit completion detecting part 58L and the second fit completion detecting part 158 function as a stopper to prevent more than necessary relative movement in the fitting direction of the second connector 101 in relation to the first connector 1. By so doing, because the second connector 101 is not pushed in more than is necessary, in other words more than the state illustrated in FIG. 14, in relation to the first connector 1, members such as the first terminal 61, the second terminal 161, and so forth are prevented from receiving damage.

Further, the timing for conductivity for when the upper end surface of the second fit completion detecting part 158 contacts the rigid fit completion detecting part 58L is after the first contacting part 65 of the first terminals 61 complete engagement with the first contacting recessed part 165*a* of the second terminals 161 and after the second contacting part 66 of the first terminals 61 complete engagement with the second contacting recessed part 166*a* of the second terminals 161. In other words, the configuration is such that while the first contacting part 65 of the first terminals 61 contact the surface of the first contacting part 165 of the second terminals 161 but has still not yet entered into the first contacting recessed part 165*a*, or while the second contacting part 66 of the first terminals 61 contacts the surface of the second contacting part 166 of the second terminals 161 but has still not yet entered into the second contacting recessed part 166*a*, the upper end surface of the second fit completion detecting part 158 does not contact the rigid fit completion detecting part 58L and fit completion between the first connector 1 and the second connector 101 is not detected.

Therefore, the upper end surface of the second fit completion detecting part 158, and particularly the location where it contacts the rigid fit completion detecting part 58L, requires that higher dimension accuracy be provided over the other parts of the second main body part 152. Note, the location where the rigid fit completion detecting part 58R is contacted can have a low degree of dimensional accuracy because the flexible fit completion detecting part 58R can flexibly displace.

Further, the description provided in the present embodiment is for when the rigid fit completion detecting part 58L and the second fit completion detecting part 158 function as a stopper, however as long as at least one from among a plurality of switching members with the ability for mutual contact included in the switch and function as a stopper, it is acceptable.

Because the first reinforcing bracket 51 and the second reinforcing bracket 151 are used as a part of the detection circuit for detecting fit a completion in this manner in the present embodiment, it is not necessary to attach a member for detecting the fit completion to the first connector 1 and the second connector 101, and increasing the size and the number of components in the first connector 1 or the second connector 101 can be prevented. In addition, because the first terminals 61 or the second terminals 161 are not used in the detection circuit, the number of terminals or the number of poles are essentially not reduced. In addition, because the detection pad 194 does not need to be formed on the second board 191 as in the first embodiment, the configuration of the second board 191 can be simplified. Additionally, because the second board 191 is not included as a part of the detection circuit as in the first embodiment, the configuration of the detection circuit can be further simplified.

Further, in the present embodiment, a pair of second fit completion detecting parts 158 is placed on a diagonal line of the second connector 101 as viewed from the fitting surface side, and the tip ends of the rigid fit completion detecting part 58L and the flexible fit completion detecting part 58R that contact the second fit completion detecting part 158 are placed on a diagonal line of the first connector 1 as viewed from the fitting surface side, thus making it difficult to be affected by bowing or warpage in the first board or the second board 191, and therefore the fit completion between the first connector 1 and the second connector 101 can be securely detected.

The effect of other points are the same as the first embodiment, therefore descriptions thereof are omitted.

Figure 15:
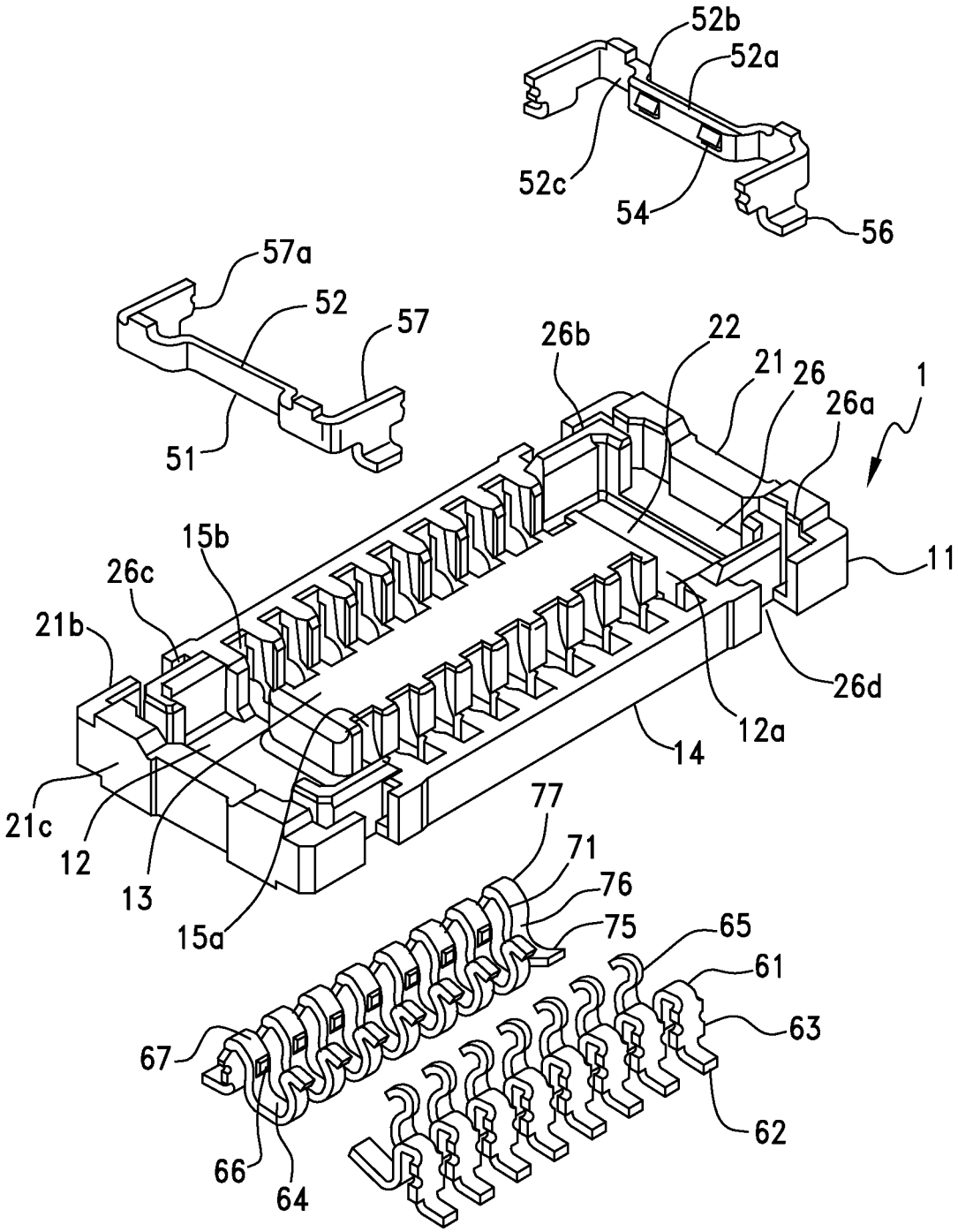
FIG. 15 is an exploded view, seen from the fitting surface side, of a first connector according to the third embodiment of the Present Disclosure.
Figure 16:
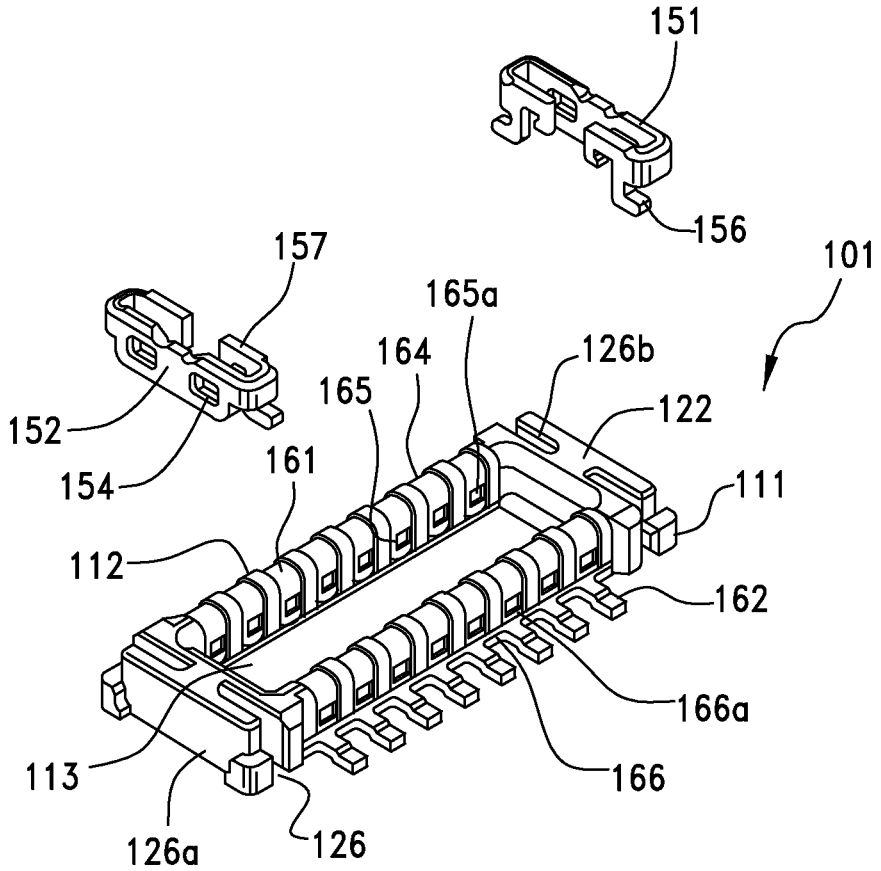
FIG. 16 is an exploded view, seen from the fitting surface side, of a second connector according to the second embodiment of the Present Disclosure.

Referring to FIGS. 15-6, the first reinforcing bracket 51 of the first connector 1 in the present embodiment is not provided with the fit completion detecting part 58, and the first board connecting part 56 is connected to the lower ends of both of the left and right first arm parts 57. With regard to the other points, the configuration of the first reinforcing bracket 51 in the present embodiment is similar to the first reinforcing bracket 51 in the first embodiment.

Further, the first connector 1 in the present embodiment has a fit completion detecting terminal 71 as the fit completion detecting part in place of one of the first terminals 61. In the example illustrated in FIG. 15, the fit completion detecting terminal 71 is arranged in place of the first terminal 61 that corresponds to the first terminal receptacle cavity 15 positioned at the right upper end in the example of the first terminal receptacle cavity 15 formed on the left side of the first housing number 11.

The fit completion detecting terminal 71 is a member integrally formed by a working process such as stamping or bending a conductive metal plate, and is provided with, as illustrated in FIGS. 17 to 20 to be described hereinafter, a retention receiving part 73, a tail part 72 connected to the lower end of the retention receiving part 73, an upper side connecting part 77 connected to the upper end of the retention receiving part 73, a side surface connecting part 76 formed in the vicinity of the inward end of the upper side connecting part 77, and a fit completion detecting part 75 connected to the lower end of the side surface connecting part 76.

Further, the retention receiving part 73 extends in a vertical direction, that is to say the thickness direction, of the first housing 11 and is a part that is engaged and held with the first terminal receptacle outer side cavity 15*b*. In addition, the tail part 72 is connected by bending in relation to the retention receiving part 73, and extends outward in the width direction of the first housing 11, and is connected by soldering or the like to a terminal connection pad that is linked to a conductive trace on the first board. Furthermore, the upper side connecting part 77 is connected by bending in relation to the retention receiving part 73 and extends inward in the width direction of the first housing 11.

The side surface connecting part 76 that extends downward is connected to the inner end of the upper side connecting part 77, and the fit completion detecting part 75 with a cantilever shape that extends at a slant upward as well as extending inward in the width direction of the first housing 11 is connected to the lower end of the side surface connecting part 76. The fit completion detecting part 75 functions as a spring member and the tip end thereof, in other words the entire body including the free end, can be flexibly displaced in the vertical direction.

The fit completion detecting terminal 71 is inserted into the first terminal receptacle cavity 15 from the mounting surface side (lower side in the drawing), and is anchored to the first housing 11 by being held from both sides by the side walls of the first terminal receptacle outer side cavities 15*b* where the retention receiving part 73 is formed to the side surface of the inner side of the side wall part 14. In this state, and other words the state in which the fit completion detecting terminal 71 is loaded on the first housing 11, the side surface connecting part 76 stops within the first terminal receptacle outer side cavity 15*b* and is not exposed within the recessed groove part 12*a*. Meanwhile, the fit completion detecting part 75 his position to the lower side within the recessed groove part 12*a*.

Further, other points of configuration with the first connector 1 are the same as the first embodiment, and therefore descriptions thereof are omitted. Further, the configuration of the second connector 101 in the present embodiment is the same as the first embodiment, and therefore descriptions thereof are omitted.

However, in the present embodiment, the detection circuit for detecting the fit completion between the first connector 1 and the second connector 101 is configured so that a conductive trace formed on the surface of the first board not illustrated where the tail part 72 of the fit completion detecting terminal 71 is linked to the connected terminal connection pad on the first board not illustrated, and a conductive trace with the tail part 162 of the second terminal 161 is linked to the connected terminal connection patent 192 on the second board 191, by connecting to both terminals of a testing device similar to a tester for testing the conductive a state of the electric circuits. By so doing, when conductivity occurs by the second terminal 161 that corresponds to the fit completion detecting terminal 71 contacting the fit the completion detecting terminal 71, the detection circuit closes and the conductivity state is detected by the testing device and thus the fit completion between the first connector 1 and the second connector 101 is electrically detected. In other words, in the present embodiment, the fit completion detecting terminal 71 and the second terminal 161 that corresponds to the fit completion detecting terminal 71 functions as a switching member for a fit completion detection switch.

Referring to FIGS. 17-20, the first connector 1 is surface mounted on the first board with the tail part 62 of the first terminals 61 and the tail part 72 of the fit completion detect internal 71 and is connected by soldering or the like to the terminal connection pad that is linked to a conductive trace on the first board not illustrated in the drawing while the first board connecting part 56 of the first reinforcing bracket 51 is connected by soldering or the like to the anchoring pad on the first board.

Further, the second connector 101 is surface mounted on the second board 191 with the tail part 162 of the second terminals 161 being connected by soldering or the like to the terminal connection pad 192 that is linked to a conductive trace on the second board 191, and the second board connecting part 156 of the second reinforcing bracket 151 is connected by soldering or the like to the anchoring pad 193 of the second board 191. Note, the present embodiment omits the second board 191 from the drawing.

Figure 17:
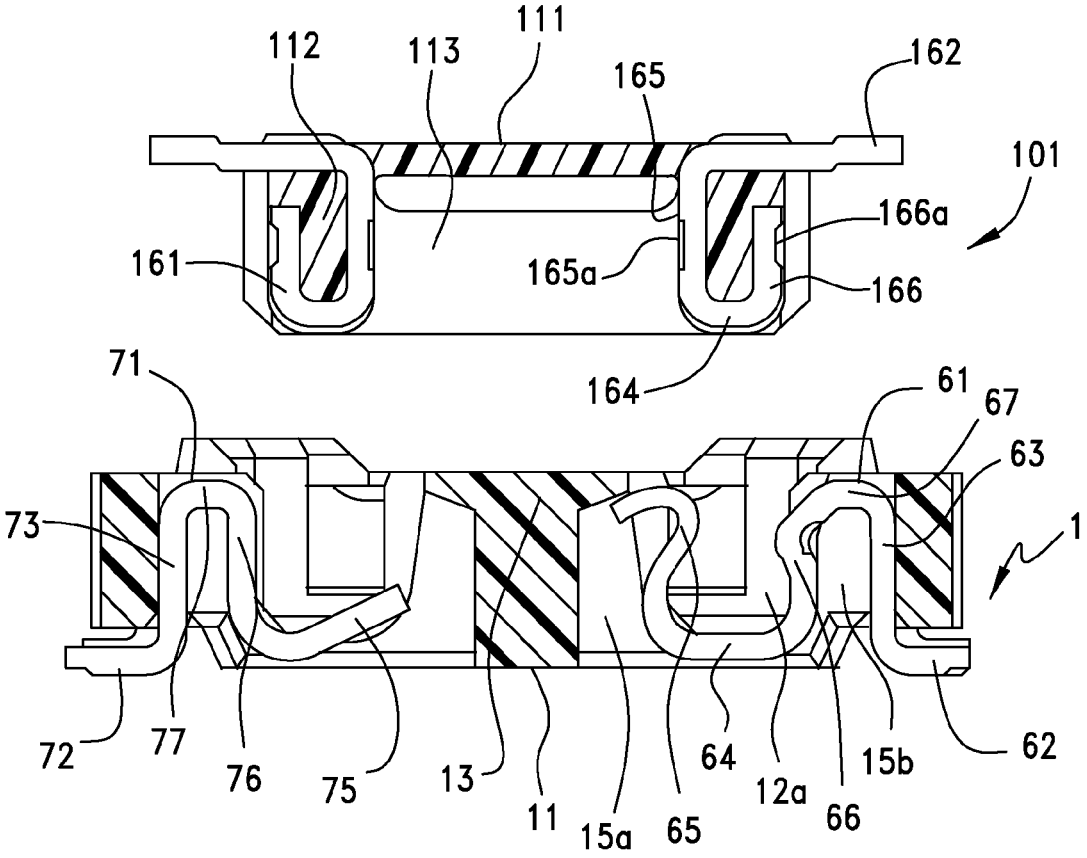
FIG. 17, which illustrates the step of the fitting process of FIG. 5, is a cross-sectional view corresponding to the visual portion of Arrows A-A in FIG. 2 and illustrates the relationship between the fit completion detecting terminal and the second terminal.

First, the operator, as illustrated in FIG. 17, positions the first connector 1 and the second connector 101 to make a state in which the fitting surface of the first connector 1 faces the fitting surface of the second connector 101 in a similar manner to the first embodiment, then moves the first connector 1 and/or a second connector 101 in a direction to approach the side of the other, that is to say the fitting direction.

Figure 18:
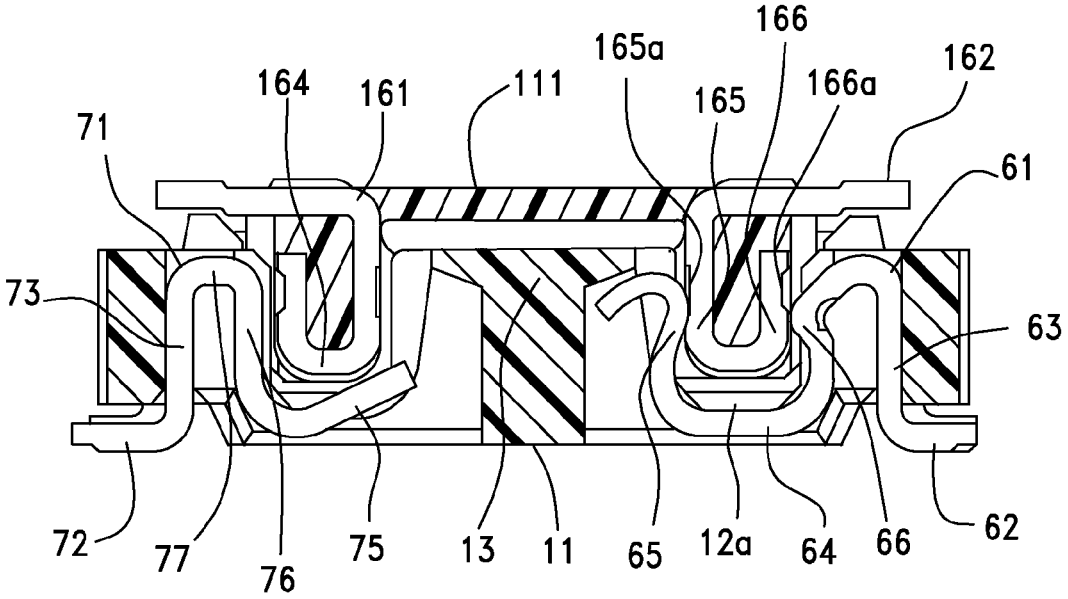
FIG. 18, which illustrates the step of the fitting process of FIG. 6, is a cross-sectional view corresponding to the visual portion of Arrows A-A in FIG. 2 and illustrates the relationship between the fit completion detecting terminal and the second terminal.

By so doing, the left and right second ridged parts 112 of the second connector 101 are inserted into the left and right recessed groove parts 12*a* of the first connector 1. Further, the second terminals 161 of the second connector of 101 are inserted between the first contacting parts 65 and the second contacting parts 66 of each of the first terminals 61, and the first contacting parts 65 of the first terminals 61 contact with the surfaces of the first contacting parts 165 of the second terminals 161 and the second contacting parts 66 of the first terminals 61 contact with the surfaces of the second contacting parts 166 of the second terminals 161. By so doing, the gap between the first contacting part 65 and the second contacting part 66 in the first terminals 61 is widened by the second terminals 161 to flexibly elongate. Furthermore, as illustrated in FIG. 18, the fit completion detecting terminal 71 of the first connector 1 does not contact the second terminal 161.

Figure 19:
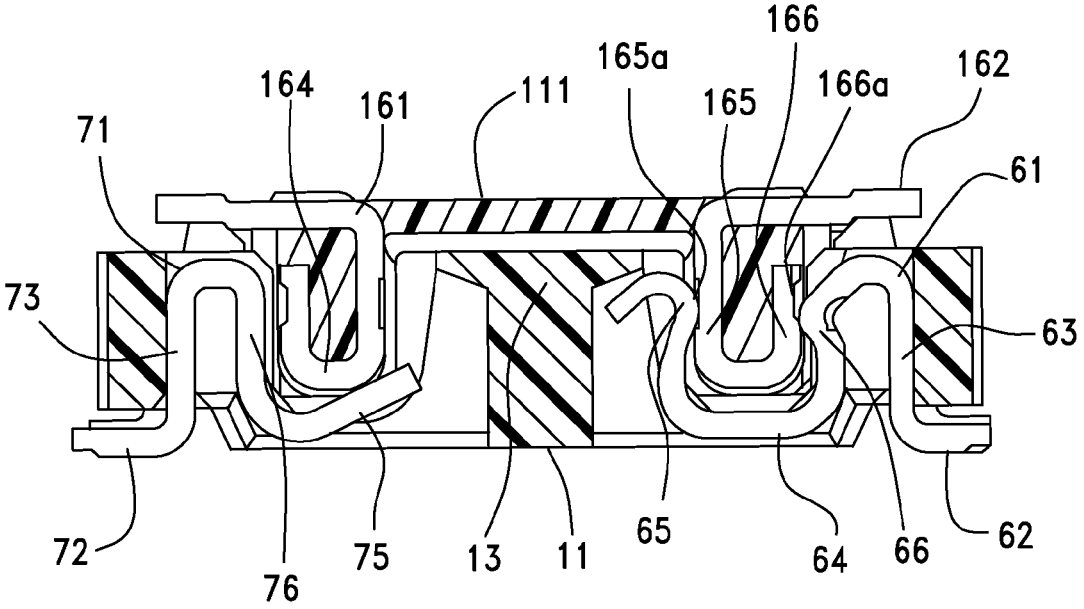
FIG. 19, which illustrates the step of the fitting process of FIG. 7, is a cross-sectional view corresponding to the visual portion of Arrows A-A in FIG. 3 and illustrates the relationship between the fit completion detecting terminal and the second terminal.

Next, when the operator further moves the second connector 101 relatively in a fitting direction in relation to the first connector 1, as illustrated in FIG. 19, the first contacting part 65 of the first terminals 61 enter into the first contacting recessed part 165*a* of the second terminals 161, and the first contacting part 65 is in an engaged state with the first contacting recessed part 165*a*. However, in the state illustrated in FIG. 19, the second contacting part 66 of the first terminals 61 contacts the surface of the second contacting part 166 of the second terminals 161 but but without yet entering into the second contacting recessed part 166*a* so the second contact you part 66 and the second contacting recessed part 166*a* do not engage. In such a state, the fit completion detecting terminal 71 of the first connector 1 has not yet contacted the second terminal 161. In other words, the fit completion between the first connector 1 and the second connector 101 is not detected.

Figure 20:
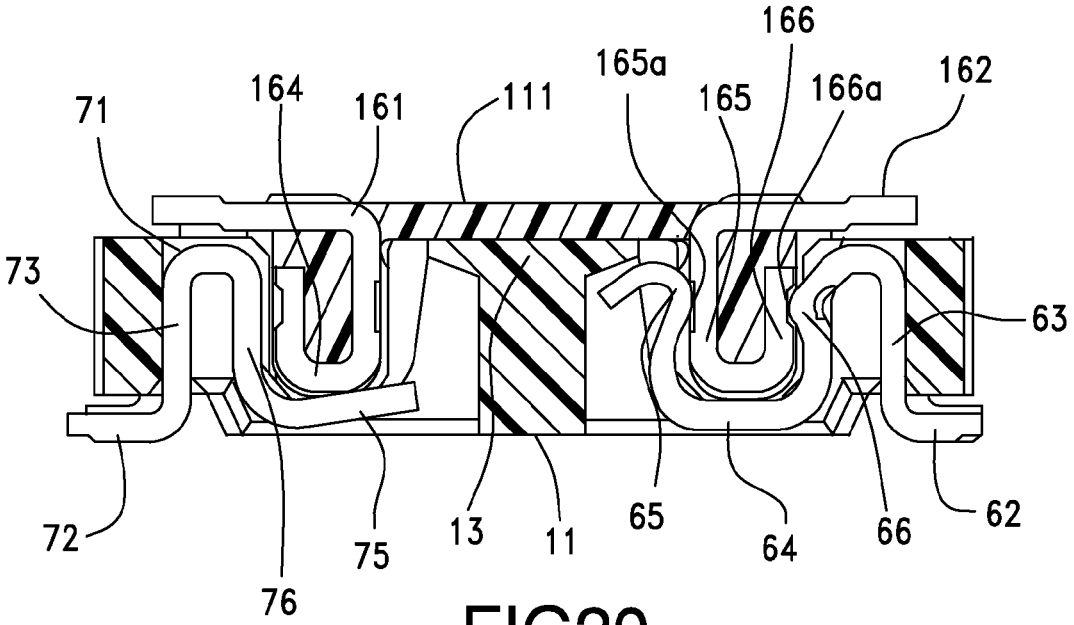
FIG. 20, which illustrates the state of the fitting process of FIG. 9, is a cross-sectional view corresponding to the visual portion of Arrows A-A in FIG. 2 and illustrates the relationship between the fit completion detecting terminal and the second terminal.
Figure 21:
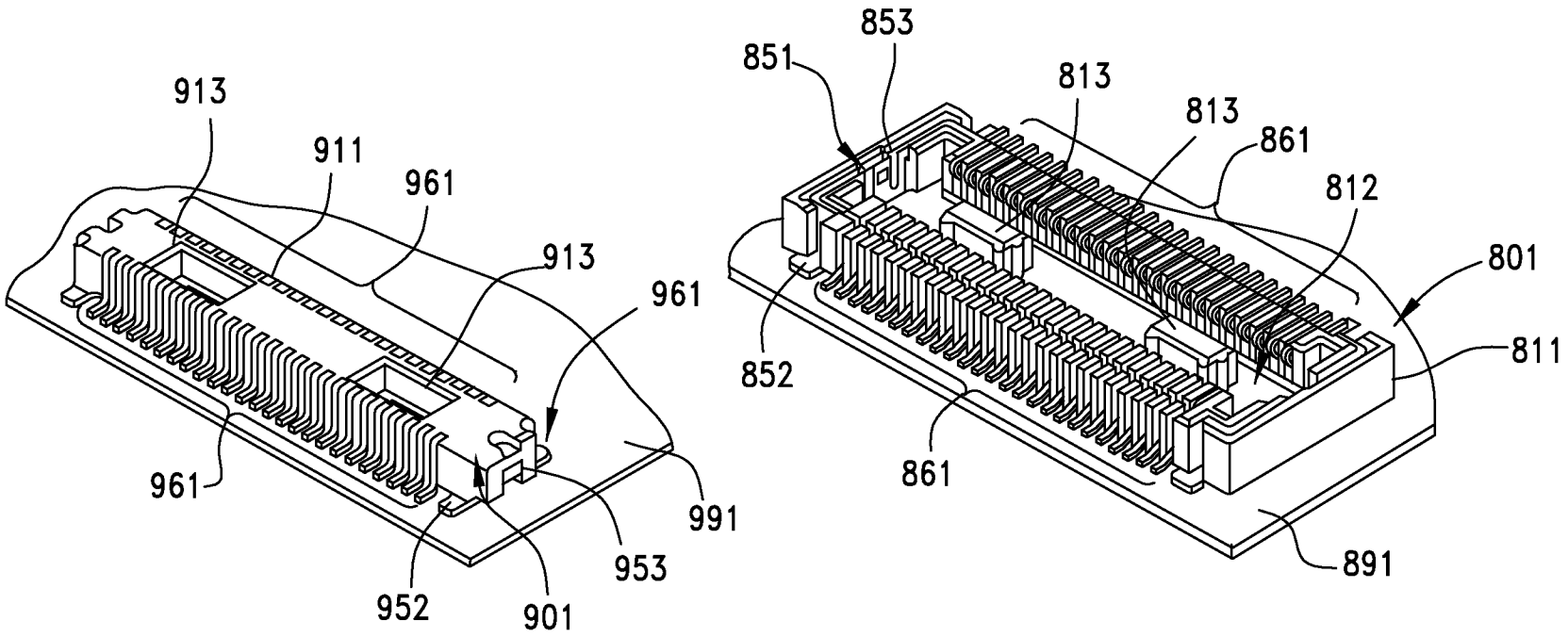
FIG.21 Prior art
FIG. 21 is a perspective view illustrating the pre-fit state of a conventional board-to-board connector.

Next, when the operator further moves the second connector 101 relatively in a fitting direction in relation to the first connector 1, the fit between the first connector 1 and the second connector 101 is complete, and as illustrated in FIG. 20, the first contacting part 65 of the first terminals 61 engage with the first contacting recessed part 165*a* of the second terminals 161, and the second contacting part 66 of the first terminals 61 is in an engaged state with the second contacting recessed part 166*a* of the second terminals 161.

As a result, there is conductivity with the conductive trace connected to the terminal connection pad on the first board where the tail part 62 of the first terminal 61 is connected, and with the conductive trace connected to the terminal connection pad 192 on the second board 191 where the tail part 162 of the second terminal 161 is connected.

Further, a locked state occurs in which the first reinforcing bracket 51 provided by the first connector 1 and the second reinforcing bracket 151 provided by the second connector 101 mutually engage. As a result, the first connector 1 and the second connector 101 are locked.

Additionally, as illustrated in FIG. 20, conductive itty occurs when the lower surface of the connecting part 164 in the second terminal 161 of the second connector 101 contacts the upper surface of the fit completion detecting part 75 in a fit completion detecting terminal 71 of the first connector 1. In other words, the switch for fit completion detection is turned on. Further, the detection circuit for detecting the fit completion between the first connector 1 and the second connector 101 closes, and the fit completion between the first connector 1 and the second connector 101 is electrically detected.

Further, when establishing the state illustrated in FIG. 20, because the upper surface of the first ridged part 13 of the first housing 11 contacts the bottom surface of the recessed groove part 113 of the second housing 111, further movement by the second connector 101 in the fitting direction in relation to the first connector 1 is prevented. In other words, the first ridged part 13 of the first housing 11 and the recessed groove part 113 of the second housing 111 function as a stopper to prevent more than necessary relative movement in the fitting direction of the second connector 101 in relation to the first connector 1. By so doing, because the second connector 101 is not pushed in more than is necessary, in other words more than the state illustrated in FIG. 20, in relation to the first connector 1, members such as the first terminal 61, the second terminal 161, and so forth are prevented from receiving damage.

Further, the timing for conductivity for when the lower surface of the connecting part 164 contacts the upper surface of the fit completion detecting part 75 is after the first contacting part 65 of the first terminals 61 complete engagement with the first contacting recessed part 165*a* of the second terminals 161 and after the second contacting part 66 of the first terminals 61 complete engagement with the second contacting recessed part 166*a* of the second terminals 161. In other words, the configuration is such that while the first contacting part 65 of the first terminals 61 contact the surface of the first contacting part 165 of the second terminals 161 but has still not yet entered into the first contacting recessed part 165*a*, or while the second contacting part 66 of the first terminals 61 contacts the surface of the second contacting part 166 of the second terminals 161 but has still not yet entered into the second contacting recessed part 166*a*, the lower surface of the connecting part 164 does not contact the upper surface of the fit completion detecting part 75 and fit completion between the first connector 1 and the second connector 101 is not detected.

In addition, the fit completion detecting part 75 in the fit completion detecting terminal 71 can flexibly displace in a vertical direction functioning as a spring member, and even if the second connector 101 is displaced in the relative fitting direction in relation to the first connector 1 from the state illustrated in FIG. 20, the conductive state with the detection pad 194 of the second board 191 can be maintained.

Because the fit completion detecting terminal 71 is attached to the first connector 1 in place of one of the first terminals 61, and because the fit completion detecting terminal 71 and the second terminal 161 corresponding thereto are used as a part of the detection circuit for detecting the fit completion in this manner in the present embodiment, increasing the size and the number of components in the first connector 1 or the second connector 101 can be prevented. In addition, because the detection pad 194 does not need to be formed on the second board 191 as in the first embodiment, the configuration of the second board 191 can be simplified.

The effect of other points are the same as the first embodiment, therefore descriptions thereof are omitted.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector, the board-to-board connector comprising:

a first connector, the first connector including a first terminal and a first housing, the first housing including a recessed portion and a first reinforcing bracket equipped thereon;

a second connector, the second connector including a second terminal and a second housing, the second terminal contacting the first terminal, the second housing including a raised portion and a second reinforcing bracket equipped thereon, the raised portion being insertable into the recessed portion; and a switch configured to detect completion of mating of the first connector and the second connector together, the switch including a plurality of switch members, each switch member having the ability to contact another switch member, one of the first and second reinforcing brackets including one of the switch members, and wherein one of the switch members functions as a stop to limit displacement in the mating direction of the first and second connectors.

2. The board-to-board connector of claim 1, wherein one of the first terminal or second terminal includes a contacting recessed part and the other includes a contacting raised part.

3. The board-to-board connector of claim 2, wherein, when the contacting recessed part and the contacting raised part engage, the switch detects the completion of mating of the first connector and the second connector together.

4. The board-to-board connector of claim 1, wherein at least one switch member flexibly displaces in the mating direction of the first connector and the second connector.

5. The board-to-board connector of claim 4, wherein one of the first terminal or second terminal includes a contacting recessed part and the other includes a contacting raised part.

6. The board-to-board connector of claim 5, wherein, when the contacting recessed part and the contacting raised part engage, the switch detects the completion of mating of the first connector and the second connector together.

7. A board-to-board connector assembly, comprising:

a first connector, the first connector including an insulative connector housing and a plurality of conductive first terminals supported by the first connector housing, the first housing including a receptacle portion, the first connector further including a first reinforcing bracket supported by the first connector housing;

a second connector, the second connector including an insulative connector housing, mateable with the first connector housing, and a plurality of conductive second terminals supported by the second connector housing, the second housing including a plug portion which is insertable into the first connector housing receptacle portion, the second connector further including a second reinforcing bracket supported by the second connector housing; and, a switch for configured to detect complete mating of the first and second connectors together, the switch including at least one switch member disposed on one of the first and second reinforcing brackets which flexibly displaces in the mating direction to contact another switch member.

* * * * *